US007381515B2

(12) United States Patent
Sugahara et al.

(10) Patent No.: US 7,381,515 B2
(45) Date of Patent: Jun. 3, 2008

(54) IMAGE FORMING METHOD AND IMAGE FORMING APPARATUS

(75) Inventors: Nobuyoshi Sugahara, Mishima (JP); Hiroyuki Fujikawa, Yokohama (JP); Koh Ishigami, Mishima (JP); Naoki Okamoto, Mishima (JP); Yoshinobu Baba, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 11/107,736

(22) Filed: Apr. 18, 2005

(65) Prior Publication Data

US 2005/0238988 A1 Oct. 27, 2005

(30) Foreign Application Priority Data

Apr. 26, 2004 (JP) ..... 2004-130278

(51) Int. Cl.
*G03G 13/16* (2006.01)

(52) U.S. Cl. ..... 430/125.32; 430/111.4; 430/125.3; 399/302

(58) Field of Classification Search ..... 430/125.32, 430/111.4, 125.22, 125.3; 399/302
See application file for complete search history.

(56) References Cited

U.S. PATENT DOCUMENTS

| | | | | |
|---|---|---|---|---|
| 5,116,711 | A | 5/1992 | Kobayashi et al. | 430/106 |
| 5,149,610 | A | 9/1992 | Kobayashi et al. | 430/106 |
| 5,164,275 | A | 11/1992 | Kobayashi et al. | 430/45 |
| 5,256,512 | A | 10/1993 | Kobayashi et al. | 430/106 |
| 6,044,243 | A | 3/2000 | Hara | 399/302 |
| 6,223,015 | B1 | 4/2001 | Takahata et al. | 399/302 |
| 7,043,183 | B2 * | 5/2006 | Yoda et al. | 399/302 |
| 2002/0186989 | A1 * | 12/2002 | Nishimura et al. | 399/297 |
| 2003/0129512 | A1 | 7/2003 | Sugino et al. | 430/66 |

FOREIGN PATENT DOCUMENTS

| | | |
|---|---|---|
| EP | 0 933 685 A1 | 8/1999 |
| EP | 1 130 478 A2 | 9/2001 |
| JP | 63-301960 | 12/1988 |
| JP | 8-292623 | 11/1996 |
| JP | 10-254251 | 9/1998 |
| JP | 11-24429 | 1/1999 |
| JP | 11-231683 | 8/1999 |
| JP | 2002-229344 | 8/2002 |

OTHER PUBLICATIONS

Office Action, dated Dec. 14, 2007, and Search Report issued in European counterpart Application No. 05 009 004.2-2209.

* cited by examiner

*Primary Examiner*—John L Goodrow
(74) *Attorney, Agent, or Firm*—Fitzpatrick, Cella, Harper & Scinto

(57) ABSTRACT

In an image forming method having primarily transferring step for transferring to an intermediate transfer member a toner image formed on a photosensitive member, secondarily transferring step for transferring to a transfer material the toner image held on the intermediate transfer member, and, after the secondary transferring step, cleaning step for removing the toner remaining on the intermediate transfer member by bringing a cleaning means into contact with the intermediate transfer member, the cleaning means is a fur brush or a charging roller, and the intermediate transfer member has a specific maximum displacement quantity (Sb) and has a specific elastic deformation percentage (Eb) (%); a toner which forms the toner image has a specific average circularity, has a specific maximum displacement quantity (St), and has a specific elastic deformation percentage (Et) (%); and the elastic deformation percentage of the intermediate transfer member and the elastic deformation percentage of the toner satisfy the following conditional expression:

$$75 \leqq Eb+Et \leqq 135.$$

4 Claims, 3 Drawing Sheets

IMAGE FORMING METHOD AND IMAGE FORMING APPARATUS

BACKGROUND OF THE INVENTION

1. Field of the Invention

This invention relates to an image forming apparatus having an intermediate transfer member and an image forming method applied to the image forming apparatus.

2. Related Background Art

Image-forming apparatus making use of an intermediate transfer belt are effective as full-color image forming apparatus or multi-color image forming apparatus in which a plurality of component-color images corresponding to full-color image information or multi-color image information are sequentially superimposingly transferred to a transfer medium to output an image-formed material on which a full-color image or multi-color image has synthetically been reproduced, or as image forming apparatus made to have the function of full-color image information or the function of multi-color image information.

Compared with image forming apparatus in which toner images are transferred from a first image bearing member (photosensitive member) to a second image bearing member (transfer medium) stuck or attracted onto a transfer belt (see, Japanese Patent Application Laid-open No. S63-301960, etc.), the image forming apparatus making use of an intermediate transfer belt have an advantage that a great variety of second image-bearing members (transfer mediums) can be selected without regard to their width and length, including thin paper (40 g/m$^2$ paper) and up to thick paper (200 g/m$^2$ paper) such as envelopes, post cards and labels. This is because it is unnecessary to make any processing or control for the second image-bearing member transfer medium (e.g., to hold the transfer medium with a gripper, hold it by attraction, and make it to have a curvature).

In addition, taking the form of an intermediate transfer belt enables effective utilization of space to make the apparatus main body compact and achieve cost reduction, because the freedom in disposing it inside the image-forming apparatus can be greater than a case in which a rigid-body cylinder such as an intermediate transfer drum is used.

Further proposed is a system in which an intermediate transfer belt having an elasticity is used. This enables securement of a sufficient transfer region, what is called a transfer nip, at a primary transfer zone between the first image bearing member such as a photosensitive member and the intermediate transfer belt and at a secondary transfer zone where the toner images are transferred to the second image bearing member.

In particular, in the case of full-color images on which toners are laid in a large quantity over the whole image areas, the above system can solve the problems that partial faulty transfer tends to occur when conventional intermediate transfer belts having no elasticity are used, color tones may differ, and white-hollowed images, or "blank areas caused by poor transfer (or hollow characters)" may occur in which center areas of lines of character images are not transferred and only edge areas thereof are transferred.

For example, Japanese Patent Applications Laid-open No. H11-231683 and No. H11-024429 disclose intermediate transfer belts having an elasticity. However, although transfer performance and hollow characters have certainly been improved or remedied in both the primary transfer and the secondary transfer, coarse images due to transfer have not been remedied.

Now, in the cleaning of toner carrying members, a blade method or a fur brush method is commonly used. The blade method is a method in which a cleaning blade such as a rubber blade is pressed against the toner carrying member to scrape toners off mechanically. As for the fur brush method, it is a method in which a cylindrical substrate with a fur brush stuck to its surface is brought into contact with the object member while being rotated and at the same time a potential difference is provided between the fur brush and the object member to be cleaned so as to attract the toner towards the fur brush side, to remove the toner from the object member mechanically or electrostatically.

In the cleaning of an elastic intermediate transfer belt, the use of the blade method causes the cleaning blade to have a large contact load against the elastic intermediate transfer belt, and the cleaning blade comes into contact with the elastic intermediate transfer belt at so strong a frictional force that the former may come to eat into the latter. This tends to, e.g., cause an increase in torque at the time of start, make the blade caught in, cause streaks due to friction scratches and make the belt move to one side because of non-uniform friction, any of which can be one of the causes that make the belt have a short lifetime. Without limitation to such an elastic intermediate transfer belt, intermediate transfer belts are component parts which require a relatively high cost. Hence, a shorter lifetime of intermediate transfer belts results in shorter intervals at which the intermediate transfer belts are to be replaced, to exercise a great influence on the cost of image formation. The intermediate transfer belts are component parts which are replaced at regular intervals, and it follows that the cost of the intermediate transfer belts is added to the cost of image formation. In recent years, it is highly required to reduce the cost of image formation also in regard to color image formation, and hence it is required to make the intermediate transfer belt have a longer lifetime. Accordingly, in order to clean the elastic intermediate transfer belt, a cleaning method that may give a small contact load is preferred. In comparison of the above two methods, the fur brush method is more suited than the blade method.

Japanese Patent Applications Laid-open No. H10-254251, No. H8-292623 and No. 2002-229344 disclose methods of belt cleaning performed by the fur brush method. All of these can enjoy a small contact load, and no longer make the elastic intermediate transfer belt have a short lifetime. However, these have not been satisfactory for the cleaning of elastic intermediate transfer belts in high-speed electrophotographic equipment.

SUMMARY OF THE INVENTION

An object of the present invention is to provide an image forming method applied to an image forming apparatus having an intermediate transfer member, in particular, an elastic intermediate transfer belt, which can achieve a good transfer efficiency, can prevent faulty images such as blank areas caused by poor transfer or coarse images due to transfer, and promises good cleaning performance for the intermediate transfer member without making its lifetime short.

Another object of the present invention is to provide an image forming apparatus to which the above image forming method is applied.

The object of the present invention can be achieved by the following.

(1) An image forming method comprising primarily transferring step for transferring to an intermediate transfer member a toner image formed on a photosensitive member, secondary transferring step for transferring to a transfer material the toner image held on the intermediate transfer member, and after the secondary transferring step, cleaning step for removing the toner remaining on the intermediate transfer member by bringing a cleaning means into contact with the intermediate transfer member, wherein;

the cleaning means is a fur brush or a charging roller;

the intermediate transfer member has a maximum displacement quantity (Sb) in the range of from 0.10 μm to 1.00 μm against a load of $9.8\times10^{-5}$ N, and has an elastic deformation percentage (Eb) (%) of 50 or more which is represented by the following expression:

$$Eb=(Sb-Ib)\times100/Sb$$

where Ib represents the plastic displacement quantity (μm) of the intermediate transfer member against the load of $9.8\times10^{-5}$ N;

a toner which forms the toner image has an average circularity of from 0.920 to 0.960 in its particles having a circle-equivalent diameter of 2 μm or more, has a maximum displacement quantity (St) in the range of from 0.06 μm to 0.24 μm against a load of $9.8\times10^{-5}$ N, and has an elastic deformation percentage (Et) (%) of from 25 to 60 which is represented by the following expression:

$$Et=(St-It)\times100/St$$

where It represents the plastic displacement quantity (μm) of the toner against the load of $9.8\times10^{-5}$ N; and the elastic deformation percentage of the intermediate transfer member and the elastic deformation percentage of the toner satisfy the following conditional expression:

$$75\leqq Eb+Et\leqq135.$$

(2) The image forming method described in (1), wherein the toner comprises toner particles having at least i) toner base particles and ii) fine particles having an average primary particle diameter of from 70 nm to 150 nm, and the fine particles are in a content of 0.5 part to 4.0 parts by weight or more based on 100 parts by weight of the toner base particles.

(3) An image forming apparatus comprising a photosensitive member, an intermediate transfer member and a cleaning means, the image forming apparatus being used in an image forming method, the image forming method comprising primarily transferring step for transferring to the intermediate transfer member a toner image formed on the photosensitive member, secondary transferring step for transferring to a transfer material the toner image held on the intermediate transfer member, and, after the secondary transferring step, cleaning step for removing the toner remaining on the intermediate transfer member, by bringing the cleaning means into contact with the intermediate transfer member, wherein;

the cleaning means is a fur brush or a charging roller;

the intermediate transfer member has a maximum displacement quantity (Sb) in the range of from 0.10 μm to 1.00 μm against a load of $9.8\times10^{-5}$ N, and has an elastic deformation percentage (Eb) (%) of 50 or more which is represented by the following expression:

$$Eb=(Sb-Ib)\times100/Sb$$

where Ib represents the plastic displacement quantity (μm) of the intermediate transfer member against the load of $9.8\times10^{-5}$ N;

a toner which forms the toner image has an average circularity of from 0.920 to 0.960 in its particles having a circle-equivalent diameter of 2 μm or more, has a maximum displacement quantity (St) in the range of from 0.06 μm to 0.24 μm against a load of $9.8\times10^{-5}$ N, and has an elastic deformation percentage (Et) (%) of from 25 to 60 which is represented by the following expression:

$$Et=(St-It)\times100/St$$

where It represents the plastic displacement quantity (μm) of the toner against the load of $9.8\times10^{-5}$ N; and the elastic deformation percentage of the intermediate transfer member and the elastic deformation percentage of the toner satisfy the following conditional expression:

$$75\leqq Eb+Et\leqq135.$$

DESCRIPTION OF THE PREFERRED EMBODIMENTS

Figure 1:
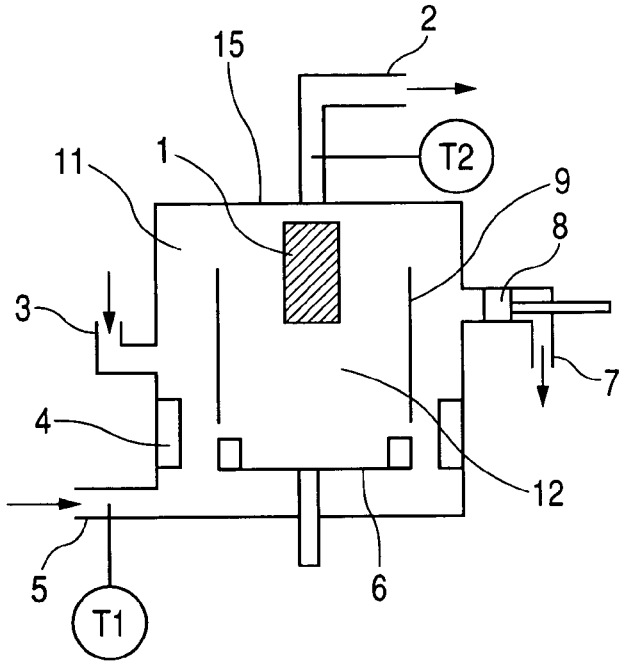
FIG. 1 is a schematic sectional view showing an example of a surface modifying apparatus used in sphering the particles of the toner of the present invention.

The present invention is described below in detail.

The subject of the present invention is to improve cleaning performance of an intermediate transfer member which has superiority in transfer efficiency and prevention of blank areas caused by poor transfer the surface of which has an elasticity (an elastic intermediate transfer member). In particular, the present invention is effective in using an elastic intermediate transfer belt, with which it is difficult to bring a cleaning member into contact at a high pressure, because it has no mandrel. A means for cleaning the intermediate transfer member includes assemblies for cleaning such as blade cleaning, fur brush cleaning, and electrostatic cleaning making use of a charging roller, or combination of any of these.

In the method in which the cleaning of the surface of such an elastic intermediate transfer member is performed by applying a load to the intermediate transfer member as in the blade cleaning, the application of a large contact load of a cleaning blade to the elastic intermediate transfer member makes the cleaning blade come into contact therewith at so strong a frictional force that the blade may come to eat into the elastic intermediate transfer member, to shorten the lifetime of the latter. Hence, the fur brush cleaning having a relatively small load against the intermediate transfer member and the electrostatic cleaning (charging roller) or combination of these are effective in the cleaning of the elastic intermediate transfer member.

These methods have certainly been very effective in electrophotographic equipment having a low image reproduction speed. However, especially in electrophotographic equipment which reproduces images at a high speed, the cleaning performance has been so insufficient as to cause faulty cleaning in some cases.

In the first place, the present inventors have attempted to, e.g., make the fur brush have a higher hardness or more fur in order to improve cleaning performance. They have also attempted to enlarge the area of contact between the charging roller and the elastic intermediate transfer belt to improve frictional characteristics of the elastic intermediate transfer belt and charging roller. However, such methods have resulted in the shortening of lifetime of the elastic intermediate transfer belt.

Accordingly, the present inventors have studied a method which enables effective cleaning by making toner's physical properties themselves into physical properties by which the cleaning is physically easy to perform.

The present inventors have measured what physical deformation the toner and the intermediate transfer member may undergo at such a small load that a cleaning mechanism such as the fur brush or the charging roller applies to the toner and intermediate transfer member at the time of cleaning. Then, as a result of the measurement on the above, they have discovered that the above subject can be achieved when the relationship of physical properties between the toner and the intermediate transfer member fulfills specific conditions.

In the present invention, the maximum displacement quantity (St) of the toner is the amount in which what deformation the toner undergoes at maximum against a specific load. The plastic displacement quantity (It) is the value showing the amount in which the toner having deformed upon application of a specific load stands deformed without returning to the original state, at the moment when the load has been removed. Then, the elastic deformation percentage (Et) (%) calculated from the above St and It is represented by the following expression:

$$Et=(St-It)\times 100/St.$$

Similarly, the elastic deformation percentage (Eb) (%) calculated from the maximum displacement quantity (Sb) and plastic displacement quantity (Ib) of the intermediate transfer member is represented by the following expression:

$$Eb=(Sb-Ib)\times 100/Sb.$$

Where the cleaning mechanism such as the fur brush cleaning or the charging roller cleaning is used, good cleaning performance has been found to be achievable when the sum of the elastic deformation percentage of the toner and that of the intermediate transfer member, i.e., Et+Eb is 75% to 135%. The fur brush cleaning has been found to be effective especially when used in high-speed electrophotographic equipment.

The value of Et+Eb represents that what elasticity the whole intermediate transfer member and toner have against such a weak load as in the fur brush cleaning. If the value of Et+Eb is smaller than 75%, the toner and intermediate transfer member may deform with difficulty against the weak load as in the fur brush cleaning, and hence any transfer residual toner may poorly be scraped off, and the transfer residual toner may remain on the intermediate transfer member in a large quantity even after it has passed the cleaning assembly, so that no good images may come obtainable. Scratches also tend to be made on the intermediate transfer member.

If on the other hand the value of Et+Eb is larger than 135%, the toner and the intermediate transfer member have so high an elasticity in turn that the intermediate transfer member and the toner may greatly deform, and the load of brush to be transmitted to the toner and intermediate transfer member may come non-uniform. Hence, some of the toner tends to adhere onto the intermediate transfer member or not to be scraped off to remain on the intermediate transfer member.

In the present invention, the maximum displacement quantities and elastic deformation percentages of the toner and intermediate transfer member have specific values. These are individually significant.

In the present invention, the toner has a maximum displacement quantity (St) of from 0.06 μm to 0.24 μm, and more preferably from 0.07 μm to 0.22 μm, against a load of $9.8\times10^{-5}$ N. If its St is less than 0.06 μm, toner scattering or crushed lines may occur when toner images formed on the photosensitive member pass through the zone where they are in contact with the intermediate transfer member and transferred, so that a feeling of coarseness may appear on images held on the transfer material. If on the other hand it is more than 0.24 μm, the toner may melt-adhere to the intermediate transfer member.

The toner also has an elastic deformation percentage (Et) of from 25% to 60%, and preferably from 27% to 55%, against a load of $9.8\times10^{-5}$ N. If the toner has an elastic deformation percentage of less than 25%, the toner may crush when it passes through a contact nip between the photosensitive member and the intermediate transfer member, so that some toner not transferred onto the photosensitive member may remain thereon, resulting in a poor primary-transfer efficiency. If on the other hand the toner has an elastic deformation percentage of more than 60%, the toner may deform before, when, e.g., reclaimed paper having a large surface unevenness is used as the transfer material, the toner comes into the interiors of dales of such unevenness, so that the toner may eat into the transfer material with difficulty. Hence, this may result in a poor efficiency of secondary transfer, i.e., transfer from the intermediate transfer member to the transfer material.

As to the plastic displacement quantity of the toner against a load of $9.8\times10^{-5}$ N, there are no particular limitations thereon as long as it is the value that satisfies the above relationship. As a preferable range, it may be from 0.05 μm to 0.20 μm.

The maximum displacement quantity of the toner is influenced by the molecular weight or crosslink density of a binder resin in toner base particles. Hence, it may be controlled by the composition of a resin, the addition of a cross-linking agent, the addition of resin components capable of adjusting hardness, the kneading temperature in the step of melt kneading in producing toner base particles, the manner in which shear is applied in that step, and so forth. For example, the addition of a cross-linking agent to toner base particles makes the maximum displacement quantity small. Also, by applying larger kneading shear at a low temperature, molecular chains of binder resin components of the toner can be cut to enlarge the maximum displacement quantity.

The plastic displacement quantity of the toner may be controlled by selecting additives to toner base particles. For example, a release agent may be added to enlarge the plastic displacement quantity. Also, a charge control agent capable of acting as a filler may be added with selection to lessen the plastic displacement quantity.

The elastic deformation percentage of the toner is a value calculated from the maximum displacement quantity and the plastic displacement quantity, and hence can be kept within the above range by controlling these.

In conventional toners, they have tended to have a large maximum displacement quantity and also a large plastic displacement quantity, and hence, in high-speed electrophotographic equipment making use of an intermediate transfer member, have had a problem that they melt adhere to the intermediate transfer member or have a poor secondary-transfer efficiency.

The intermediate transfer member has a maximum displacement quantity (Sb) of from 0.10 μm to 1.00 μm, and more preferably from 0.15 μm to 0.90 μm, against a load of $9.8\times10^{-5}$ N. If its Sb is less than 0.10 μm, toner particles may be crushed when the toner passes through the contact zone, and hence some of the toner may adhere to the photosensitive member to remain thereon as it is, without being transferred, to tend to cause blank areas caused by poor transfer. If it is more than 1.00 μm, a very soft elastic layer must be used in the intermediate transfer member, and hence the intermediate transfer member may have an extremely short lifetime.

The intermediate transfer member also has an elastic deformation percentage (Eb) of 50% or more, and preferably from 55% to 90%. If its Eb is less than 50%, the intermediate transfer member may return to the original state with difficulty after it has deformed when it passes through the contact zone, and hence the time of contact between it and the photosensitive member or the transfer material may come short. Hence, this may result in a poor efficiency for both the primary transfer and the secondary transfer.

As to the plastic displacement quantity of the intermediate transfer member against a load of $9.8\times10^{-5}$ N, there are no particular limitations thereon in the present invention. As a preferable range, it may be from 0.05 μm to 0.50 μm. The plastic displacement quantity discussed herein is the amount in which the intermediate transfer member having deformed upon application of a specific load stands deformed without returning to the original state, at the moment when the load has been removed, and is not meant to be that the deformation continues forever after the load has been removed.

The maximum displacement quantity of the intermediate transfer member may be controlled by the physical properties of a resin or rubber used in the elastic layer of the intermediate transfer member, or by the thickness of its surface layer. The plastic displacement quantity of the intermediate transfer member may be controlled by the thickness of the elastic layer or the quantity of additives. Also, the elastic deformation percentage of the intermediate transfer member is the value calculated from the maximum displacement quantity and the plastic displacement quantity, and hence can be kept within the above range by controlling these. Specific physical properties of and production methods for the intermediate transfer member will be described later.

The toner of the present invention has an average circularity of from 0.920 to 0.960 in its particles having a circle-equivalent diameter of 2 μm or more, among particles contained in the toner. This average circularity substantially represents the average circularity of toner particles, and may preferably be from 0.925 to 0.955. Inasmuch as the toner and the intermediate transfer member have maximum displacement quantities and elastic deformation percentages within the above ranges as in the present invention and further the toner particles are made spherical within the specific range, both the primary-transfer efficiency and the secondary-transfer efficiency have been improved without damaging developing performance. Also, the effect of providing fluidity in virtue of external additives has been made greater.

If the toner has an average circularity of less than 0.920, the effect of providing fluidity in virtue of external additives may be so small as to make the toner have a low fluidity to cause non-uniformity in charge quantity of the toner, tending to cause a lowering of transfer efficiency and cause coarseness seriously. If on the other hand it has an average circularity of more than 0.960, it may make the intermediate transfer member have a poor cleanability, or may seriously adhere to the intermediate transfer member. This average circularity may be controlled by surface modification for sphering toner base particles.

The binder resin used in the present invention is described next.

As the binder resin usable in the present invention, any of those known as binder resins for toners may be used. Preferred is a resin selected from (a) a polyester resin, (b) a hybrid resin having a polyester unit and a vinyl polymer unit, (c) a mixture of the hybrid resin and a vinyl polymer, (d) a mixture of a polyester resin a vinyl polymer, (e) a mixture of the hybrid resin and a polyester resin, and (f) a mixture of a polyester resin, the hybrid resin and a vinyl polymer.

In the case when the polyester resin is used as the binder resin, a polyhydric alcohol, a polybasic carboxylic acid, a polybasic carboxylic anhydride or a polybasic carboxylic ester may be used as a raw-material monomer.

Stated specifically, as a dihydric alcohol component for example, it may include bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hyd roxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As a dibasic carboxylic acid monomer component, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; and unsaturated dicarboxylic acids such as fumaric acid, maleic acid and citraconic acid, or anhydrides thereof.

As a tribasic or higher carboxylic acid component for forming a polyester resin having cross-linked moieties, it may include, e.g., 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides or ester compounds of these.

Of these, a polyester resin having as the dihydric alcohol (diol) component a bisphenol derivative represented by the following general formula (A) and as an acid component a carboxylic acid component composed of a dibasic or higher carboxylic acid or an anhydride thereof or a lower alkyl ester thereof (e.g., fumaric acid, maleic acid, maleic anhydride, phthalic acid, terephthalic acid, trimellitic acid or pyromellitic acid), and obtained by polycondensation of these is particularly preferred because it affords good charge characteristics as color toners.

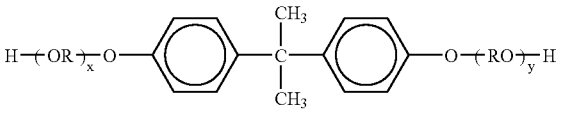

wherein R represents an ethylene group or a propylene group, x and y are each an integer of 1 or more, and the average value of x+y is 2 to 10.

In the binder resin contained in the toner of the present invention, the "hybrid resin" is meant to be a resin in which a vinyl polymer unit and a polyester unit have chemically combined. Stated specifically, it is a resin formed by ester interchange reaction of a polyester unit with a vinyl polymer unit made up by polymerizing a monomer having a carboxylate group such as an acrylate or methacrylate, and may preferably be a graft copolymer (or a block copolymer) composed of the vinyl polymer unit as the backbone polymer and the polyester unit as the branch polymer. Incidentally, the "polyester unit" referred to in the present invention indicates a moiety derived from polyester. The "vinyl polymer unit" indicates a moiety derived from a vinyl monomer. As polyester monomer constituting the polyester unit, usable are polybasic carboxylic acid components and polyhydric alcohol components. As vinyl monomers constituting the vinyl polymer unit, usable are monomers having vinyl groups.

As the vinyl monomer for forming the vinyl polymer unit, it may include styrene; styrene derivatives such as o-methylstyrene, m-methylstyrene, p-methylstyrene, α-methylstyrene, p-phenylstyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups as exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene.

In the toner of the present invention, the vinyl polymer unit in the binder resin may have a cross-linked structure, cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxythylene(2)-2,2-bis(4-hydroxyphenyl)propane diacrylate, polyoxythylene(4)-2,2-bis(4-hydroxyphenyl)propane diacrylate, and the above compounds whose acrylate moiety has been replaced with methacrylate.

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

In the present invention, it is preferable that any one or both of the vinyl polymer unit and the polyester unit is/are incorporated with a monomer component capable of reacting with components of both the resin units. Among monomers constituting the polyester resin unit, a monomer capable of reacting with the vinyl polymer unit component may include, e.g., unsaturated dicarboxylic acids such as fumaric acid, maleic acid, citraconic acid and itaconic acid, or anhydrides thereof. Among monomers constituting the vinyl polymer unit, a monomer capable of reacting with components of the polyester unit component may include monomers having a carboxyl group or a hydroxyl group, and acrylates or methacrylates.

As a method for obtaining the reaction product of the vinyl polymer unit with the polyester resin unit, preferred is a method in which, in the state a polymer which contains monomer components capable of respectively reacting with the above vinyl polymer unit and the above polyester resin unit are present, polymerization reaction for any one or both of the polymers is carried out to obtain it.

As a polymerization initiator used when the vinyl polymer unit used in the present invention is produced, it may include, e.g., azo compounds such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and other types such as 2,2-bis(t-butylperoxy) butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyazelate.

As methods by which the hybrid resin used in the present invention can be produced may include, e.g., the following production methods shown in (1) to (5).

(1) A method of separately producing a vinyl polymer and a polyester resin, and thereafter dissolving and swelling them in a small amount of an organic solvent, followed by addition of an esterifying catalyst and an alcohol and then heating to effect ester interchange reaction.

(2) A method of first producing a vinyl polymer and thereafter producing a polyester unit and a hybrid resin component in the presence of the vinyl polymer. The hybrid resin component is produced by allowing the vinyl polymer unit (a vinyl monomer may optionally be added) to react with a polyester monomer (such as a polyhydric alcohol or a polybasic carboxylic acid) and allowing the above unit and monomer to react with a polyester optionally added. In this case, too, an organic solvent may appropriately be used.

(3) A method of first producing a polyester resin and thereafter producing a vinyl polymer unit and a hybrid resin component in the presence of the polyester resin. The hybrid resin component is produced by allowing the polyester unit (a polyester monomer may optionally be added) to react with a vinyl monomer and allowing the above unit and monomer to react with a vinyl polymer unit optionally added. In this case, too, an organic solvent may appropriately be used.

(4) A vinyl polymer and a polyester resin are first produced and thereafter any one or both of a vinyl monomer and a polyester monomer (such as a polyhydric alcohol or a polybasic carboxylic acid) is/are added in the presence of these polymer units, followed by polymerization reaction under conditions which accord with the monomers added, to produce the hybrid resin component. In this case, too, an organic solvent may appropriately be used.

(5) A vinyl monomer and a polyester monomer (such as a polyhydric alcohol or a polybasic carboxylic acid) are mixed to effect addition polymerization and polycondensation reaction continuously to produce a vinyl polymer unit, a polyester unit and a hybrid resin component. An organic solvent may further appropriately be used.

In the above production processes (1) to (5), a plurality of polymer units having different molecular weights and different degrees of cross-linking may be used as the vinyl polymer unit and the polyester unit. Incidentally, the vinyl polymer or vinyl polymer unit in the present invention is meant to be a vinyl homopolymer or a vinyl copolymer, or a vinyl homopolymer unit or a vinyl copolymer unit.

Not referring to detailed production processes, it is important in the present invention to select monomer composition, catalysts and reaction conditions, because the maximum displacement quantity (St) of the toner is concerned with the composition and molecular weight of binder resins.

Colorants may be used in the present invention. As black colorants, usable are carbon black or magnetic materials. Also usable are colorants toned in black by using yellow colorants, magenta colorants and cyan colorants.

As colorants used when the toner of the present invention is used in color toners, known dyes and pigments may be used.

As color pigments for magenta toner, they may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; and C.I. Pigment Violet 19.

As the colorant, the pigment may be used alone. In view of image quality of full-color images, it is more preferable to use the dye and the pigment in combination so that the color sharpness can be improved.

As color dyes for magenta toner, they may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

As color pigments for cyan toner, they may include C.I. Pigment Blue 2, 3, 15:3, 15:4, 16, 17; C.I. Vat Blue 6; C.I. Acid Blue 45; and copper phthalocyanine pigments the phthalocyanine skeleton of which has been substituted with 1 to 5 phthalimide methyl group(s), having a structure represented by the following formula:

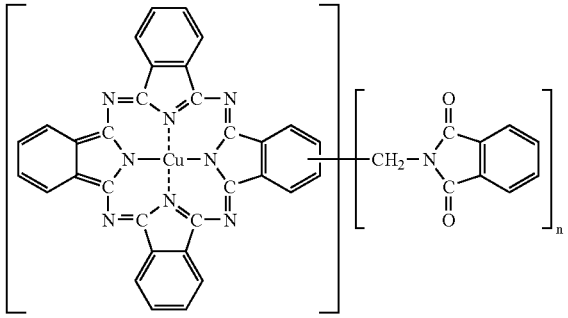

wherein n represents an integer of 1 to 5.

As color pigments for yellow toner, they may include C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 151, 154, 155, 168, 174, 175, 176, 180, 181, 185.

As color dyes for yellow toner, they may include C.I. Solvent Yellow 162, and a dye and the pigment may also preferably be used in combination.

The pigment may be used in an amount of from 0.1 to 15 parts by weight, more preferably from 0.5 to 12 parts by weight, and most preferably from 0.6 to 10 parts by weight, based on 100 parts by weight of the binder resin.

In the present invention, a release agent may also be used. The release agent is commonly added in order to provide a toner which exhibits excellent fixing performance also in electrophotographic equipment having an oil-less fixing mechanism. In the present invention, it may also preferably be used as a material for controlling the plastic displacement quantity and elastic deformation percentage of the toner.

As the release agent, those commercially available may be used. As examples thereof, the release agent may include the following. It may include aliphatic hydrocarbon waxes such as low-molecular weight polyethylene, low-molecular weight polypropylene, low-molecular weight alkylene copolymers, microcrystalline wax, paraffin wax and Fischer-Tropsch wax; oxides of aliphatic hydrocarbon waxes, such as polyethylene oxide wax, or block copolymers of these; ester waxes such as behenyl behenate and stearyl stearate; waxes composed chiefly of a fatty ester, such as carnauba wax and montanate wax, or those obtained by subjecting part or the whole of fatty esters to deoxidizing treatment, such as dioxidized carnauba wax. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylene bis(stearic acid amide), ethylene bis(capric acid amide), ethylene bis(lauric acid amide) and hexamethylene bis(stearic acid amide); unsaturated fatty acid amides such as ethylene bis(oleic acid amide), hexamethylene bis(oleic acid amide), N,N'-dioleyladipic acid amide and N,N'-dioleylsebasic acid amide; aromatic bisamides such as m-xylene bisstearic acid amide and N,N'-distearylisophthalic acid amide; fatty acid metal salts (those commonly called metal soap) such as calcium stearate, calcium laurate, zinc stearate and magnesium stearate; waxes grafted using vinyl monomers such as styrene and acrylic acid, to fatty acid hydrocarbon waxes; partially esterified products of polyhydric alcohols with fatty acids, such as monoglyceride behenate; and methyl ester compounds having a hydroxyl group, obtained by hydrogenation of vegetable fats and oils.

Release agents particularly preferably usable in the present invention may include aliphatic hydrocarbon waxes. For example, preferred are low-molecular weight polyalkylene waxes obtained by polymerizing alkylenes by radical polymerization under high pressure, or by polymerization under low pressure in the presence of a Ziegler catalyst or a metallocene catalyst; paraffin waxes; Fischer-Tropsch waxes synthesized from coal or natural gas; alkylene polymers obtained by thermal decomposition of high-molecular weight alkylene polymers; and synthetic hydrocarbon waxes obtained from, or by hydrogenation of, distillation residues of hydrocarbons obtained by the Arge process from synthetic gases containing carbon monoxide and hydrogen. Hydrocarbon waxes fractionated by using press sweating, solvent fractionation or vacuum distillation or by a fractionation recrystallization system may more preferably be used.

The hydrocarbons, serving as a matrix, may include those synthesized by reacting carbon monoxide with hydrogen in the presence of a metal oxide type catalyst (preferably catalysts of a two or more multiple system), as exemplified by hydrocarbon compounds synthesized by the Synthol process or the Hydrocol process (making use of a fluidized catalyst bed); hydrocarbons having about several hundred carbon atoms, obtained by the Arge process (making use of a fixed catalyst bed), which can obtain waxy hydrocarbons in a large quantity; hydrocarbons obtained by polymerization of alkylenes such as ethylene in the presence of a Ziegler catalyst; and paraffin wax; all of which are preferable as having less and smaller branches and being saturated long straight chain hydrocarbons. In particular, waxes synthesized by the method not relying on the polymerization of alkylenes are preferred in view of their molecular weight distribution.

A charge control agent may be used in the toner in the present invention. This enables control of charge quantity. As the charge control agent, known ones may be used. An aromatic carboxylic acid metal compound is particularly preferred, which is colorless, makes the toner chargeable at a high speed and can stably maintain a constant charge quantity. Such an aromatic carboxylic acid metal compound further has the effect of improving crosslink of the toner and acting as a filler, and is very effective in controlling the plastic displacement quantity and elastic deformation percentage of the toner as in the present invention. In particular, an aluminum complex of an aromatic oxycarboxylic acid is especially preferred as the charge control agent and also as a cross-linkability improver.

As negative charge control agents, usable are salicylic acid metal compounds, naphthoic acid metal compounds, dicarboxylic acid metal compounds, polymer type compounds having sulfonic acid or carboxylic acid in the side chain, boron compounds, urea compounds, silicon compounds, and carixarene. As positive charge control agents, usable are quaternary ammonium salts, polymer type compounds having such a quaternary ammonium salt in the side chain, guanidine compounds, and imidazole compounds. The charge control agent may internally be added, or may externally be added, to toner base particles. The charge control agent may preferably be added in an amount of from 0.2 to 10 parts by weight based on 100 parts by weight of the binder resin.

The fine particles having an average primary particle diameter of from 70 nm to 150 nm which may be used in the state they are externally added to toner base particles are described next. The fine particles may preferably be in a content of 0.5 part to 4.0 parts by weight based on 100 parts by weight of the toner base particles. More preferably, the fine particles may also have an average primary particle diameter of from 90 nm to 140 nm, and may be in a content of from 0.8 to 2.0 parts by weight. Usually, the fine particles having an average primary particle diameter of from 70 nm to 150 nm are added in order to improve transfer efficiency as a transfer aid. In the present invention, it has further been discovered that such fine particles also has the function to improve cleaning performance in the construction where the elastic intermediate transfer belt is cleaned with a fur brush. If the fine particles have an average primary particle diameter of less than 70 nm, not only they may less contribute to the improvement in transfer performance, but also it is difficult to well improve the cleaning performance for the elastic intermediate transfer belt. If on the other hand, the fine particles have an average primary particle diameter of more than 150 nm, melt adhesion of toner to or scratching on the intermediate transfer member tends to occur a little seriously. Also, if the fine particles are added in an amount of less than 0.5 part by weight, the effect of improving the transfer performance and the cleaning performance for the elastic intermediate transfer belt is not so well obtainable.

As the fine particles, it is preferable to use spherical silica. This is because such spherical silica of 70 nm to 150 nm in average primary particle diameter has the function to adsorb the toner that is not easily removable by cleaning, to make it readily collectible with the fur brush, and also functions as an abrasive against the toner standing adherent to the elastic intermediate transfer belt in a state close to melt adhesion. In particular, preferred is spherical silica having an average primary particle diameter of from 70 nm to 150 nm which has been produced by what is called the sol-gel process, in which an alkoxysilane is subjected to hydrolysis and condensation reaction in the presence of a catalyst in a water-containing organic solvent to obtain a silica sol suspension, from which the solvent is removed, which is then dried, and made into particles.

Incidentally, it has come about that the 70 to 150 nm silica itself is collected in the fur brush with difficulty where the 70 to 150 nm fine particle silica is used when the value of Et+Eb is less than 75%. It has also come about that, when the value of Et+Eb is more than 135%, the 70 to 150 nm fine particles tend to behave as nuclei to cause melt adhesion of toner onto the elastic intermediate transfer belt.

In the toner of the present invention, a fluidity improver may also externally be added to the toner base particles in addition to the above fine particles having an average primary particle diameter of from 70 nm to 150 nm. This is preferable from the viewpoint of improving image quality.

As the fluidity improver, preferred are inorganic fine powders such as fine silica powder, fine titanium oxide powder and fine aluminum oxide powder, which may more preferably be those having further been made hydrophobic using a hydrophobic-treating agent such as a silane coupling agent, a silicone oil or a mixture of these.

The fluidity improver may usually be used in an amount of from 0.5 to 5 parts by weight based on 100 parts by weight of the toner base particles.

In the fluidity improver in the present invention, titanium oxide and silica may preferably be used in combination. Particularly preferred titanium oxide and silica are shown below.

As the titanium oxide, preferred are elliptically spherical rutile-type hydrophobic fine titanium oxide particles having been surface-treated with a silane compound or coupling agent and/or a silicone oil or silicone varnish, and more preferred are those having at least an average primary particle diameter of from 8 nm to 100 nm and a length/breadth ratio of from 1.1 to 5.0 on the surfaces of toner base particles.

For the silica as the fluidity improver, it is preferable to have been surface-treated with a silane compound or coupling agent and/or a silicone oil or silicone varnish. It is particularly for them to have been surface-treated with a silicone oil.

In the toner of the present invention, the elastic deformation percentage is set higher, though a little, than that of conventional toners. Hence, there has been an anxiety that the fluidity improver tends to come buried in toner base particles. However, the elliptically spherical rutile-type one functions advantageously against burying, and moreover, as standing buried appropriately, has the function to more improve running performance than conventional toners. Also, the fine silica powder and the fine titanium oxide powder which have been treated with silicone oil also have, like the above fine particles having an average primary particle diameter of from 70 nm to 150 nm, the function to adsorb the toner that is not easily removable by cleaning and also the function to make the toner thus adsorbed readily separable from the elastic intermediate transfer belt.

A magnetic carrier which may be used in the present invention is described next.

Where the toner of the present invention is used in two-component developers, the toner is used in the form of its blend with a magnetic carrier. As the magnetic carriers, usable are, e.g., particles of metals such as iron, nickel, copper, zinc, cobalt, manganese, chromium and rare earth elements, which may be surface-oxidized or unoxidized, and alloy particles or oxide particles of any of these, and ferrite particles.

A coated carrier obtained by coating the particle surfaces of the above magnetic carrier particles with a resin is particularly preferred in developing methods in which an AC bias is applied to a developing sleeve. As methods for coating, applicable are conventionally known methods such as a method in which a coating fluid prepared by dissolving or suspending a coating material such as a resin in a solvent is made to adhere to the surfaces of magnetic carrier particles, and a method in which the magnetic carrier particles and the coating material are mixed in the form of a powder.

The coating material on the surfaces of magnetic carrier particles may include silicone resins, polyester resins, styrene resins, acrylic resins, polyamide, polyvinyl butyral and aminoacrylate resins. Any of these may be used alone or in plurality.

In the treatment with the coating material, it may preferably be in an amount of from 0.1 to 30% by weight, and more preferably from 0.5 to 20% by weight, based on the weight of the magnetic carrier particles. The magnetic carrier may preferably have a number-average particle diameter of from 10 μm to 100 μm, and more preferably from 20 μm to 70 μm.

Where the two-component developer is prepared by blending the toner of the present invention and the magnetic carrier, they may preferably be blended in a proportion of from 2% by weight to 15% by weight as toner concentration in the developer to obtain good results, and more preferably from 4% by weight to 13% by weight.

In the toner of the present invention, its circularity may be controlled by the use of a specific surface modifying apparatus which makes the shape of toner base particles close to a spherical shape. Such surface modification for the shape of toner base particles enables achievement of a high transfer performance.

The apparatus which makes the toner base particles have a spherical shape may include, e.g., heat treatment apparatus such as Surfusion (manufactured by Nippon Pneumatic MFG Co., Ltd.), which makes particles spherical by melting their surfaces by heat, and a hot-air type sphering apparatus (manufactured by Hosokawa Micron Corporation). It may also include Hybridizer (manufactured by Nara Machinery Co., Ltd.), which makes particles spherical by mechanical impact treatment, Turbo Mill (manufactured by Turbo Kogyo Co., Ltd.), Criptron (manufactured by Kawasaki Heavy Industries, Ltd.) and Mechanofusion System (manufactured by Hosokawa Micron Corporation).

Such sphering surface modification may also preferably be carried out also taking account of the matter concerning the bleeding of release agent to the toner base particle surfaces. An apparatus which can make such surface modification may include the following apparatus.

FIG. 1 illustrates an example of a surface modifying apparatus which may preferably be used.

The surface modifying apparatus shown in FIG. 1 has a casing 15; a jacket (not shown) through which cooling water or an anti-freeze can be passed; a classifying rotor 1 which is a classifying means which classifies particles into those having particle diameters larger than stated ones and fine particles having particle diameters not larger than the stated ones; a dispersing rotor 6 which is a surface modifying means which applies mechanical impact to particles to make the surface modification of the particles; a liner 4 disposed along the dispersing rotor 6, keeping a stated clearance with respect to the outer periphery of the latter; a guide cylinder 9 which is a guide means which guides to the dispersing rotor 6 the particles having particle diameters larger than the stated ones among the particles classified by the classifying rotor 1; a fine-powder collecting discharge opening 2 which is a discharging means through which the fine particles having particle diameters not larger than the stated ones among the particles classified by the classifying rotor 1 are discharged to the outside of the apparatus; a cold air inlet 5 through which cold air is introduced into the system, which cold air is a particle circulation means which sends to the classifying rotor 1 the particles having been surface-modified by the dispersing rotor 6; a material feed opening 3 for introducing into the casing 15 the particles to be surface modified; and a powder discharge opening 7 and a discharge valve 8 which are provided open-close operably for discharging out of the casing 15 the particles having been surface-modified.

The classifying rotor 1 is a cylindrical rotor, and is provided on the top surface side in the casing 15. The fine-powder collecting discharge opening 2 is provided at the top of the casing 15 so that the particles inside the classifying rotor 1 can be discharged therethrough. The material feed opening 3 is provided at the middle of the peripheral wall of the casing 15. The cold air inlet 5 is provided on the bottom side of the peripheral wall of the casing 15. The powder discharge opening 7 is provided in the peripheral wall of the casing 15 at its position set opposite to the material feed opening 3. The discharge valve 8 is a valve which opens or closes the powder discharge opening 7 as desired.

Figure 2:
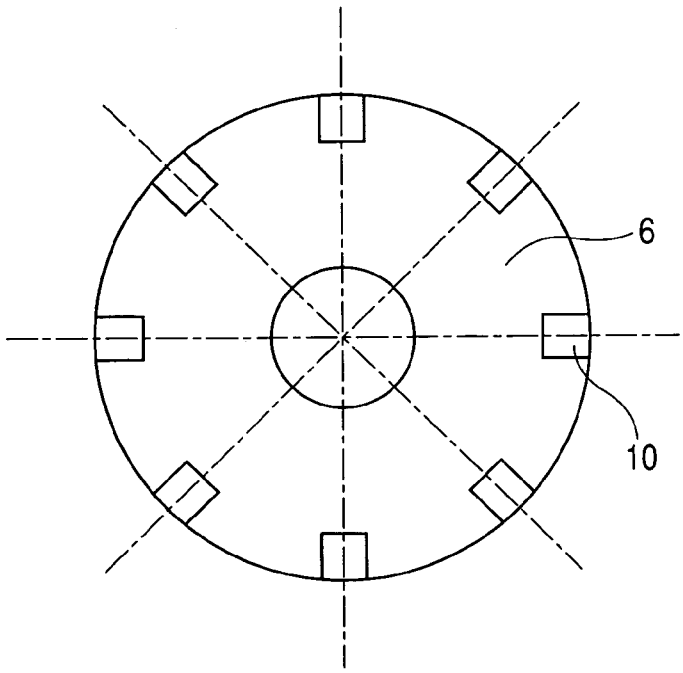
FIG. 2 is a schematic view showing an example of the top surface of a dispersing rotor shown in FIG. 1.

The dispersing rotor 6 and the liner 4 are provided between the cold air inlet 5, and the material feed opening 3 and the powder discharge opening 7. The liner 4 is provided along the inner peripheral surface of the casing 15. The dispersing rotor 6 has, as shown in FIG. 2, a disk and, on the peripheral edge of this disk, a plurality of rectangular pins 10 disposed along the normal of the disk. The dispersing rotor 6 is provided on the bottom side of the casing 15, and is provided at the position that provides a stated clearance formed between the liner 4 and the rectangular pins 10. The guide cylinder 9 is provided at the middle of the casing 15. The guide cylinder 9 is provided at the middle of the casing 15. The guide cylinder 9 is a hollow cylindrical body, and is so provided as to extend from the position that partly covers the outer peripheral surface of the classifying rotor 1, and up to the vicinity of the dispersing rotor 6. The guide cylinder 9 forms a first space 11 which is a space provided between the outer peripheral surface of the guide cylinder 9 and the inner peripheral surface of the casing 15 and a second space 12 which is the space inside the guide cylinder 9.

Incidentally, the dispersing rotor 6 may have cylindrical pins in place of the rectangular pins 10. The liner 4 is, in this embodiment, one provided with a large number of grooves in its surface set opposite to the rectangular pins 10. Instead, it may be one having no groove on that surface. Also, the classifying rotor 1 may be, as its direction of installation, of a vertical type as shown in FIG. 1, or a lateral type. The classifying rotor 1 may also be, as its number, provided alone as shown in FIG. 1, or in plurality.

In the surface modifying apparatus constituted as described above, a finely pulverized product is introduced in a stated quantity through the material feed opening 3 in the state the discharge valve 8 is closed, whereupon the finely pulverized product introduced is first sucked by a blower (not shown), and then classified by the classifying rotor 1. In that classification, the classified fine powder having particle diameters not larger than the stated ones passes the peripheral surface of the classifying rotor 1, is guided to the inside of the classifying rotor 1, and is continuously discharged and removed out of the apparatus. Coarse powder having particle diameters not smaller than the stated ones rides on circulating flows generated by the dispersing rotor 6, along the inner periphery of the guide cylinder 9 (in the second space 12) by the aid of centrifugal force, and is guided to a gap between the rectangular pins 10 and the liner 4 (hereinafter also "surface modification zone"). The powder guided to the surface modification zone undergoes mechanical impact force between the dispersing rotor 6 and the liners 4, and is surface-modified. The surface-modified particles, having been subjected to surface modification, ride on the cold air passing through the interior of the apparatus, and is transported to the classifying rotor 1 along the outer periphery of the guide cylinder 9 (in the first space 11), where fine powder is further discharged out of the apparatus by the action of the classifying rotor 1, and coarse powder, riding on the circulating flows, is again returned to the the second space 12 to undergo surface modification action repeatedly in the surface modification zone. Thus, in the surface modifying apparatus shown in FIG. 1, the classification of particles by means of the classifying rotor 1 and the surface modification of particles by means of the dispersing rotor 6 are repeated. After lapse of a certain time, the discharge valve 8 is opened to collect the surface-modified particles through the discharge opening 7.

In such an apparatus, the bleeding of release agent that is due to heat may little occur. Compared with the known system in which mechanical impact force is applied as mentioned above, the bleeding of release agent to toner particle surfaces that is due to come-out of new surfaces may also little occur, and the sphering of toner base particles and the control of the bleeding of release agent can be carried out with ease. Thus, such an apparatus is very preferred.

Figure 3:
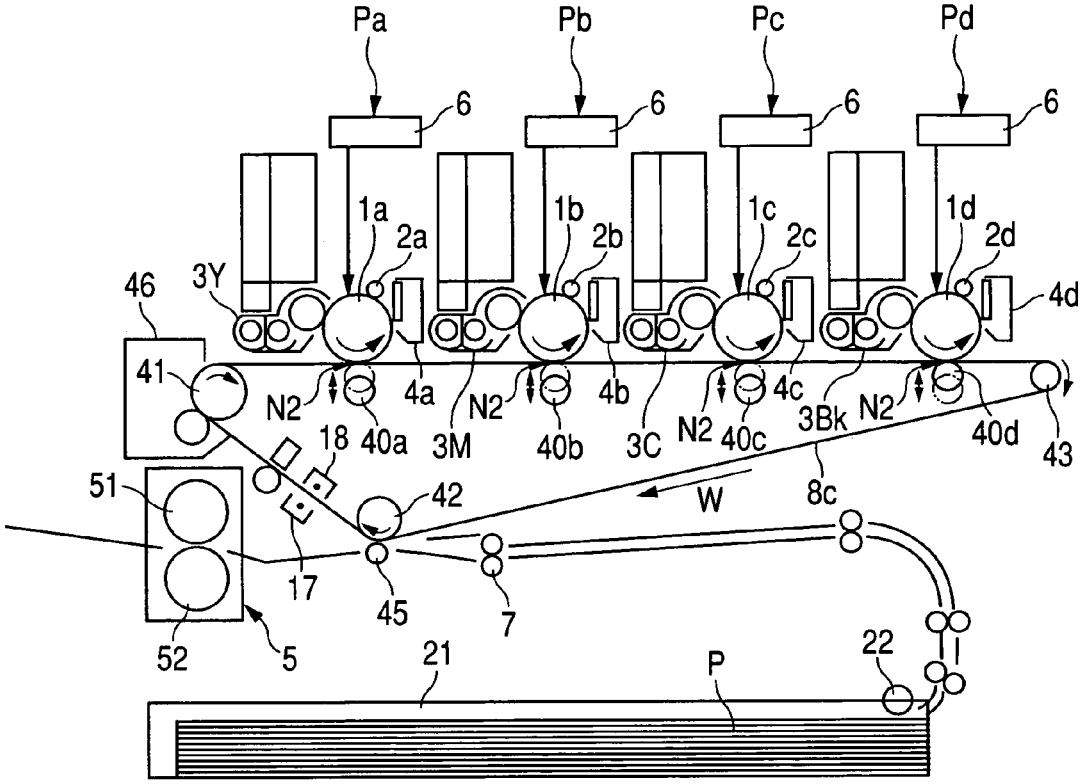
FIG. 3 schematically illustrates the construction of the image forming apparatus according to the present invention.

An apparatus that satisfies the construction of the image forming apparatus of the present invention is shown in FIG. 3.

This image forming apparatus is a tandem type electrophotographic image forming apparatus of a system of multiple transfer on intermediate transfer member, in which image forming sections having image bearing members and also respective means for performing charging, exposure and development to form toner images on the image bearing members are side by side provided in plurality, where respective-color toner images formed on the image bearing members are multiple-transferred onto an intermediate transfer member serving as a second image bearing member, and thereafter the toner images having been multiple-transferred onto the intermediate transfer member serving as a second image bearing member are en bloc transferred onto a recording medium.

As shown in FIG. 3, the image forming apparatus of this working example has image forming sections Pa, Pb, Pc and Pd in which images for respective colors of yellow, magenta, cyan and black are formed. In the image forming sections, toner images for the respective colors are formed on photosensitive drums 1*a*, 1*b*, 1*c* and 1*d* by the use of primary charging means 2*a* to 2*d*, exposure means 6 and developing assemblies 3Y, 3M, 3C and 3Bk for the respective colors of yellow, magenta, cyan and black.

In this apparatus, a belt-shaped intermediate transfer member which is a second image bearing member, i.e., an intermediate transfer belt 8*c* holds thereon toner images having been multiple-transferred from the surfaces of the photosensitive drums 1*a* to 1*d* and formed, and transports the toner images to a secondary-transfer zone at which they are to be en bloc transferred onto a recording medium P. The intermediate transfer belt 8*c* is put around over a drive roller 43, a tension roller 41 and a secondary-transfer opposing roller 42 as a secondary-transfer opposing member, and is driven in the direction of an arrow W shown in FIG. 3.

The photosensitive drums 1*a*, 1*b*, 1*c* and 1*d* are set opposite to primary-transfer charging rollers 40*a*, 40*b*, 40*c* and 40*d*, respectively, as primary-transfer charging means, interposing the intermediate transfer belt 8*c* between them.

On start of the operation of image formation, the intermediate transfer belt 8*c* is rotated in the direction of an arrow W, and the respective-color toner images having been formed on the photosensitive drums 1*a* to 1*d* are sequentially superimposingly electrostatically transferred onto the intermediate transfer belt 8*c* at primary-transfer zones N2 by the action of the primary-transfer charging rollers 40*a* to 40*d*. Thereafter, toners having remained on the photosensitive drums without being transferred are removed by cleaning means 4*a* to 4*d*.

Incidentally, according to this working example, the respective primary-transfer charging rollers 40*a* to 40*d* feed electric charges to the intermediate transfer belt 8*c* over its range broader than each image formation region thereon, and transfer the toner images onto the intermediate transfer belt 8*c* from the photosensitive drums 1*a* to 1*d*.

Meanwhile, a recording medium P kept in a recording medium holding cassette 21 is sent out of it and to the interior of the image forming apparatus by means of a recording medium feed roller 22, and is held between registration rollers 7. Thereafter, it is sent to the secondary-transfer zone in such a way that it synchronizes with the time that the leading edge of the toner images having been multiple-transferred onto the intermediate transfer belt 8*c* enters the secondary-transfer zone where a secondary-transfer charging roller 45 as a secondary-transfer charging means and the secondary-transfer opposing member secondary-transfer opposing roller 42 stand opposite to each other and come into contact with the intermediate transfer belt 8*c*. Then, the toner images held on the intermediate transfer belt 8*c* are en bloc transferred onto the recording medium P by the action of the secondary-transfer charging roller 45.

Thereafter, the recording medium P having held thereon unfixed toner images is transported to a fixing assembly 5 having a fixing roller 51 and a pressure roller 52, and heat and pressure are applied thereto, whereby the unfixed toner images are fixed onto the recording medium P and thus a fixed image is formed. Also, toners and so forth having remained on the intermediate transfer belt 8*c* after the toner images have secondarily been transferred onto the recording medium P are destaticized by destaticizers (charge eliminating assemblies) 17 and 18 to remove their electrostatic attraction force, and thereafter removed by an intermediate transfer belt cleaner 46 having a cleaning means.

The intermediate transfer belt used in the present invention is described next.

As materials used in the intermediate transfer belt, those composed of fluorine resin, polycarbonate resin, polyimide resin or the like have conventionally been used. In recent years, an elastic belt all the layers or some part of which is/are formed of an elastic material has come into use.

Figure 5A:
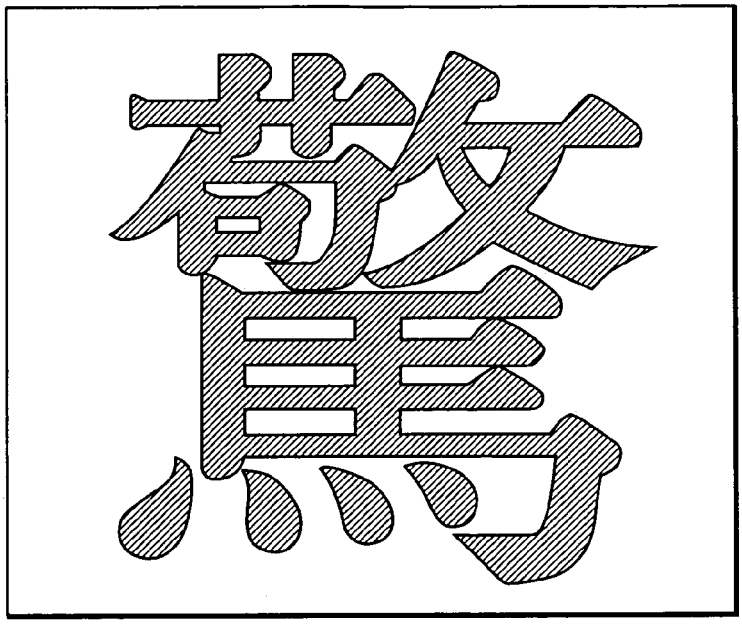
FIGS. 5A and 5B illustrate a character pattern (5A) used in making evaluation on blank areas caused by poor transfer, and a blank (hollowed) state (5B).
Figure 5B:
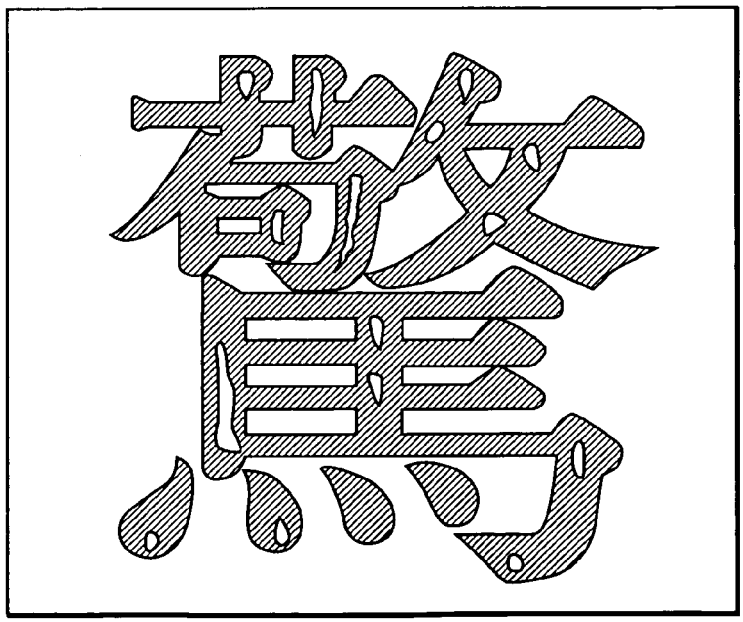

In the transfer of color images by using as an intermediate transfer member a belt having a low elasticity, there are the following problems. Color images are usually formed by colored toners of four colors. In a one-sheet color image, from one-layer to four-layer toner layers are formed. Hence, the toner layers have large thickness, and tend to undergo a high pressure when they pass primary transfer (transfer from the photosensitive members to the intermediate transfer belt) or pass secondary transfer (transfer from the intermediate transfer belt to the sheet), so that the toners mutually tend to come to have a high cohesive force. For example, where a character like that shown in FIG. 5A is reproduced in colors, the toners mutually have so high a cohesive force as to tend to cause a phenomenon of what is called hollow characters like that shown in FIG. 5B, in which images are reproduced in the state that toners in the vicinity of edges of a character or in the vicinity of edges of lines are not transferred, or cause a phenomenon of blank edges in solid-image areas. The belt having a low elasticity does not deform correspondingly to the toner layers, and hence tends to compress the toner layers to come to stick to the photosensitive member at a large force. Hence, the phenomenon of hollow characters tends to come about. Also, recently, it has come to be highly wanted to form full-color images on various sheets as exemplified by Japan paper and sheets intentionally made to have unevenness. However, sheets having a poor smoothness tend to produce air space in respect to toners at the time of transfer to tend to cause blank areas caused by poor transfer. If the transfer pressure at the secondary-transfer zone is made higher in order to bring the sheet into higher close contact, it comes about that the toner layers have a higher cohesive force, and also that this causes the hollow characters as stated above.

Accordingly, in recent years, an intermediate transfer belt having an elastic layer attracts notice as the intermediate transfer belt. Such an elastic intermediate transfer belt is used at an aim as stated below. The elastic intermediate transfer belt has a low hardness, and hence deforms correspondingly to the toner layers at the transfer zone and to the sheets having a poor smoothness. That is, the elastic intermediate transfer belt deforms following up any local unevenness, and hence can well bring the sheet into close contact without making the transfer pressure excessively higher against the toner layers. Thus, transferred images can be obtained which are free of any hollow characters and have good uniformity also in respect to the sheets having a poor smoothness.

The elastic intermediate transfer belt used in the present invention is a belt in which all layers or some layer is/are made up of a material having an elasticity. Such a material having an elasticity may include resins having an elasticity, elastic-material rubbers, and elastomers. A surface layer (coat layer) may also be provided on an elastic layer formed of an elastic material, or a substrate layer may be provided beneath such an elastic layer.

As the resin usable in the elastic layer of the elastic intermediate transfer belt, any one or two or more resins may be used which is/are selected from the group consisting of polycarbonate, fluorine resins (ETFE, PVDF), styrene resins (homopolymers or copolymers, containing styrene or styrene derivatives) such as polystyrene, polychlorostyrene, poly-α-methylstyrene, a styrene-butadiene copolymer, a styrene-vinyl chloride copolymer, a styrene-vinyl acetate copolymer, a styrene-maleic acid copolymer, styrene-acrylate copolymers (such as a styrene-methyl acrylate copolymer, a styrene-ethyl acrylate copolymer, a styrene-butyl acrylate copolymer, a styrene-octyl acrylate copolymer and a styrene-phenyl acrylate copolymer), styrene-methacrylate copolymers (such as a styrene-methyl methacrylate copolymer, a styrene-ethyl methacrylate copolymer and a styrene-phenyl methacrylate copolymer), a styrene-α-methyl chloroacrylate copolymer and a styrene-acrylonitrile-acrylate copolymer; and methyl methacrylate resin, butyl methacrylate resin, ethyl acrylate resin, butyl acrylate resin, modified acrylic resins (such as silicone-modified acrylic resin, vinyl chloride resin modified acrylic resin, and acryl-urethane resin), vinyl chloride resin, a styrene-vinyl acetate copolymer, a vinyl chloride-vinyl acetate copolymer, rosin-modified maleic acid resins, phenolic resins, epoxy resins, polyester resins, polyester polyurethane resins, polyethylene, polypropylene, polybutadiene, polyvinylidene chloride, ionomer resins, polyurethane resins, silicone resins, ketone resins, an ethylene-ethylacrylate copolymer, xylene resins, polyvinyl butyral resins, polyamide resins, and modified polyphenylene oxide resins. Note as a matter of course that examples are by no means limited to the foregoing materials.

As the elastic-material rubber or the elastomer, any one or two or more may be used which is/are selected from the group consisting of butyl rubber, fluorine rubbers, acrylic rubbers, EPDM, NBR, acrylonitrile-butadiene-styrene rubber, natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin rubbers, silicone rubbers, fluorine rubbers, polysulfide rubbers, polynorbornane rubbers, hydrated nitrile rubbers, and thermoplastic elastomers (of, e.g., a polystyrene type, a polyolefin type, a polyvinyl chloride type, a polyurethane type, a polyamide type, a polyurea type, a polyester type and a fluorine resin type). Note as a matter of course that examples are by no means limited to the foregoing materials.

A resistivity controlling conductive agent may be incorporated in the elastic intermediate transfer belt. There are no particular limitations on the resistivity controlling conductive agent. Usable are, e.g., carbon black, graphite powder, powders of metals such as aluminum and nickel, and powders of conductive metal oxides such as tin oxide, titanium oxide, antimony oxide, indium oxide, potassium titanate, antimony oxide-tin oxide composite oxide (ATO), indium oxide-tin oxide composite oxide (ITO). The conductive metal oxides may be those comprising insulating fine particles of barium sulfate, magnesium silicate, calcium carbonate or the like which have been coated with a conductive material.

The elastic intermediate transfer belt may be provided with a surface layer (coat layer) in order to improve releasability. There are no limitations on materials for the surface layer. Preferred are those which can make small the adhesion of toners to the elastic intermediate transfer belt surface to improve secondary-transfer performance. For example, a surface layer may be used in which one or two or more of polyurethane resin, polyester resin, epoxy resin and so forth is/are used and also one or two or more of powder or particles of a material capable of making surface energy smaller and making lubricity higher as exemplified by fluorine resin, a fluorine compound, fluorocarbon, titanium dioxide and silicone carbide has/have been dispersed. Also usable is a surface layer in which two or more of any of these powders or particles made to have different particle diameters has been dispersed. Still also usable is a surface layer made to have a small surface energy by carrying out heat treatment as in the case of a fluorine rubber material layer to form a fluorine-rich layer on the surface.

There are no limitations on methods for producing the elastic intermediate transfer belt. Available are a centrifugal molding method in which the material is casted into a cylindrical mold being rotated, to form a belt, a spray coating method in which a surface layer thin film is formed by spraying, a dipping method in which a cylindrical mold is put into a solution of the material and then lift it out, a casting method in which the material is casted into a space between an inner form and an outer form, and a method in which a compound (compounded product) of the material is wound around a cylindrical mold, followed by vulcanization and polishing. Also, a plurality of production methods may of course be used in combination to produce an elastic intermediate transfer belt.

As a method of preventing the elastic intermediate transfer belt from elongation, available are a method in which a rubber layer is formed on a core material resin layer having a small elongation, and a method in which a material capable of preventing elongation is mixed in a core material layer, without any particular concern about production methods.

A method of cleaning the intermediate transfer belt, usable in the present invention is described next.

As an example, a fur brush cleaning method usable in the tandem type electrophotographic image forming apparatus of a system of multiple transfer on intermediate transfer member as shown in FIG. 3 is described here. The example is by no means limited to this. For example, besides such a fur brush, a charging roller may also be used.

Figure 4:
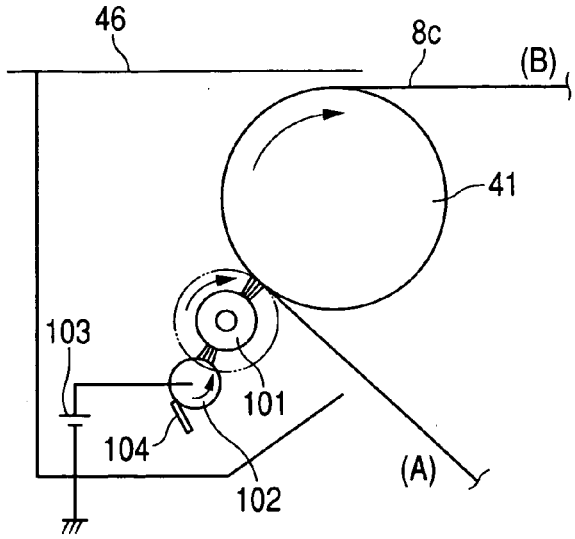
FIG. 4 is an enlarged view of an intermediate transfer belt cleaning assembly 46.

FIG. 4 is an enlarged view of the intermediate transfer belt cleaner 46 shown in FIG. 3. In FIG. 4, the intermediate transfer belt cleaner 46 has a conductive fur brush 101 as an intermediate transfer member cleaning member, which is set opposite to the tension roller 41 and comes into contact with the intermediate transfer belt 8*c* while being rotated. The conductive fur brush 101 is rotated in the same direction as the intermediate transfer belt 8*c*. In other words, these have surface movement in the directions opposite to each other at the nip position. A metal roller 102 to which a voltage with a polarity reverse to the charging polarity of the toners is kept applied from a power supply 103 is in contact with the conductive fur brush 101.

Between the metal roller 102 and the conductive fur brush 101, a potential difference is produced by the resistance of the conductive fur brush 101, where the toners removed from the intermediate transfer belt 8*c* are moved from the conductive fur brush 101 to the metal roller 102. The toners having been moved to the metal roller 102 is scraped off by a blade 104 and collected. A potential difference is also likewise produced between the intermediate transfer belt 8*c* and the conductive fur brush 101, and the conductive fur brush 101 collects the toners by the action of electrostatic force produced by an electric field and scraping force produced by contact. For example, where a voltage of +700 V is applied to the metal roller 102, the conductive fur brush 101 has a voltage of +400 V, and the toners standing negative on the intermediate transfer belt 8*c* can be removed by cleaning.

—Measurement of Maximum Displacement Quantity And Plastic Displacement Quantity of Toner and Intermediate Transfer Member—

In the present invention, the maximum displacement quantity and plastic displacement quantity of the toner and intermediate transfer member are measured with an ultra-microhardness meter ENT1100, manufactured by Elionix Co., Ltd. As an indenter used, a flat indenter of 100 μm×100 μm in square size is used, and measurement is made in a measuring environment of 27° C. and 60% relative humidity. The speed at which a load is applied is $0.98\times10^{-5}$ N/sec. After the load has reached a maximum load ($9.8\times10^{-5}$ N), it is left at that load for 0.1 second. The quantity standing displacement at this point of time is regarded as the maximum displacement quantity. Thereafter, the load is removed at a speed of $0.98\times10^{-5}$ N/sec., and the quantity of displacement at the time the load comes to be zero is regarded as the plastic displacement quantity.

1. Measurement of Maximum Displacement Quantity and Plastic Displacement Quantity of Toner:

To measure the maximum displacement quantity and plastic displacement quantity of the toner, the toner is coated on a ceramic cell, and very weak air is blown over it in such a way that the toner disperses on the cell. The resultant cell is set in the instrument to make measurement.

To make measurement, looking through a microscope attached to the instrument, one in which a toner particle is present alone in the measuring screen (breadth: 160 μm; length: 120 μm) is picked out. In order to eliminate a difference in displacement quantity of the toner, produced by the factor of particle diameter, particles having particle diameters of about ±1.0 μm of average particle diameter of the toner (those of 5 to 7 μm in particle diameter where the toner has an average particle diameter of 6 μm) are picked out to make measurement. Incidentally, the particle diameters are ascertained on the measuring screen, using a software attached to the ultra-microhardness meter ENT1100 as a measuring means. Then, to measure the respective displacement quantities, 100 particles are picked from arbitrary spots to make measurement. Particles that give data for each 10 particles on the upper limit value side and lower limit value side of the measurement results on maximum displacement quantity are excluded, and data of 80 particles are used as data for calculation. The maximum displacement quantity and the plastic displacement quantity are determined from the average data of those 80 particles.

Hitherto, an indenter having a sharp tip is used in a method of measuring the hardness of one toner particle. Hence, the toner particle may slip off the indenter, and it has been very difficult to obtain results having reproducibility. In the present invention, the flat indenter of 100 μm×100 μm in square size is used, which is larger about tens of times than the toner particle. Hence, it by no means comes about that the toner particle slips off the indenter, to have enabled measurement having good reproducibility.

2. Measurement of Maximum Displacement Quantity and Plastic Displacement Quantity of Intermediate Transfer Member:

To measure the maximum displacement quantity and plastic displacement quantity of the intermediate transfer member, a measuring sample is bonded to a cell with a curable bond. In that bonding, care must be so taken that neither air nor dust may enter the bond area. This is to prevent the displacement quantities of a sample from changing under the influence of air and/or dust. The sample is left at least for a day until the bond dries. After the bond has dried, the cell is set in the instrument, and 100-spot measurement is made at arbitrary places. Samples that give data for each 10 spots on the upper limit value side and lower limit value side of the measurement results on maximum displacement quantity are excluded, and data of the remaining 80 spots are used as data for calculation. The maximum displacement quantity and plastic displacement quantity of the intermediate transfer member are determined from the measurement results on those 80 spots.

—Measurement of Average Circularity—

The average circularity of the toner is measured with a flow type particle analyzer "FPIA-2100 Model" (manufactured by Sysmex Corporation). Description follows in regard to the circularity.

$$\text{Circle-equivalent diameter}=(\text{particle projected area}/\pi)^{1/2}\times2$$

$$\text{Circularity}=\frac{\text{Circumferential length of a circle with the same area as particle projected area}}{\text{Circumferential length of particle projected image}}$$

The circularity is calculated according to the above expressions. Here, the "particle projected area" is defined to be the area of a binary-coded toner particle image, and the "circumferential length of particle projected image" is defined to be the length of a contour line formed by connecting edge points of the toner particle image. In the measurement, used is the circumferential length of a particle image in image processing at an image processing resolution of 512×512 (a pixel of 0.3 μm×0.3 μm).

The circularity referred to in the present invention is an index showing the degree of surface unevenness of toner particles. It is indicated as 1.000 when the toner particles are perfectly spherical. The more complicate the surface shape is, the smaller the value of circularity is.

Average circularity C which means an average value of circularity frequency distribution is calculated from the following expression where the circularity at a partition point i of particle size distribution (a central value) is represented by ci, and the number of particles measured by m.

Average circularity $$C=\sum_{i=1}^{m} ci/m.$$

Incidentally, the measuring instrument FPIA-2100 used in the present invention calculates the circularity of each particle and thereafter calculates the average circularity and circularity standard deviation, where, according to circularities obtained, particles are divided into classes in which circularities of from 0.4 to 1.0 are equally divided at intervals of 0.01, and the average circularity is calculated using the divided-point center values and the number of particles measured.

As a specific way of measurement, 10 ml of ion-exchanged water from which impurity solid matter or the like has been removed is made ready in a container, and a surface active agent, preferably an alkylbenzenesulfonate, is added thereto as a dispersant. Thereafter, a sample for measurement is further added in an amount of 0.02 g, and is uniformly dispersed. As a means for dispersing it, an ultrasonic dispersion machine "TETORA 150 Model" (manufactured by Nikkaki Bios Co.) is used, and dispersion treatment is carried out for 2 minutes to prepare a liquid dispersion for measurement. In that case, the liquid dispersion is appropriately cooled so that its temperature does not come to 40° C. or more. Also, in order to keep the measurement from scattering, the flow type particle. analyzer FPIA-2100 is installed in an environment controlled to 23° C.±0.5° C. so that its in-machine temperature can be kept at 26 to 27° C., and autofocus control is performed using 2 μm latex particles at intervals of constant time, and preferably at intervals of 2 hours.

In measuring the circularity of the toner, the above flow type particle analyzer is used and the concentration of the liquid dispersion is again so controlled that the toner particle concentration at the time of measurement is 3,000 to 10,000 particles/μl, where 1,000 or more toner particles are measured. After the measurement, using the data obtained, the data of particles with a circle-equivalent diameter of less than 2 μm are cut, and the average circularity of the toner is determined.

The measuring instrument "FPIA-2100" used in the present invention is, compared with "FPIA-1000" used conventionally to calculate the shape of toner particles, an instrument having been improved in precision of measurement of toner particle shapes because of an improvement in magnification of processed particle images and also an improvement in processing resolution of images captured (from 256×256 to ->512×512), and therefore having achieved surer capture of finer particles. Accordingly, where the particle shapes must more accurately be measured as in the present invention, FPIA-2100 is more useful.

—Measurement of Particle Size Distribution of Toner—

In the present invention, the average particle diameter and particle size distribution of the toner are measured with a Coulter counter Model TA-II (manufactured by Coulter Electronics, Inc.). Coulter Multisizer (manufactured by Coulter Electronics, Inc.) may also be used. In the measurement, an electrolytic solution is used. As the electrolytic solution, an aqueous 1% NaCl solution is used. The aqueous 1% NaCl solution may be prepared using first-grade sodium chloride. For example, a commercially available product such as ISOTON R-II (available from Coulter Scientific Japan Co.) may be used.

As a method for measurement, as a dispersant 0.1 to 5 ml of a surface active agent, preferably an alkylbenzenesulfonate, is added to 100 to 150 ml of the above aqueous electrolytic solution, and further 2 to 20 mg of a sample for measurement is added. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles of 2.00 μm or larger diameter by means of the above measuring instrument, using an aperture of 100 μm as its aperture. Then the weight average particle diameter (D4) (the middle value of each channel is made a representative value for each channel) is determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

—Measurement of Molecular Weight by GPC—

The measurement of molecular weight of a chromatogram by gel permeation chromatography (GPC) is made under the following conditions.

Columns are stabilized in a heat chamber of 40° C. To the columns kept at this temperature, tetrahydrofuran (THF) as a solvent is flowed at a flow rate of 1 ml per minute, and about 50 to 200 μl of a THF sample solution of resin which has been regulated to have a sample concentration of form 0.05 to 0.6% by weight is injected thereinto to make measurement. In measuring the molecular weight of the sample, the molecular weight distribution the sample has is calculated from the relationship between the logarithmic value of a calibration curve prepared using several kinds of monodisperse polystyrene standard samples and the count number (retention time). As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Tosoh Corporation or Pressure Chemical Co., and to use at least about 10 standard polystyrene samples. An RI (refractive index) detector is used as a detector.

As columns, in order to make precise measurement in the region of molecular weight of from 1,000 to 2,000,000, it is desirable to use a plurality of commercially available polystyrene gel columns in combination. For example, they may preferably comprise a combination of Shodex GPC KF-801, KF-802, KF-803, KF-804, KF-805, KF-806 and KF-807, available from Showa Denko K.K., and μ-Styragel 500, 1,000, 10,000 and 100,000, available from Waters Co.

—Measurement of Peak Temperature of Maximum Endothermic Peak of Wax—

Temperature curve:

Heating I (30° C. to 200° C.; heating rate: 10° C./min).

Cooling I (200° C. to 30° C.; Cooling rate: 10° C./min).

Heating II (30° C. to 200° C.; heating rate: 10° C./min).

The maximum endothermic peak of the wax (release agent) is measured with a differential scanning calorimeter (DSC measuring instrument) DSC2920 (manufactured by TA Instruments Japan Ltd.). It is measured according to ASTM D3418-82.

A sample for measurement is precisely weighed in an amount of from 3 to 7 mg, preferably from 4 to 5 mg. This sample is put in an aluminum pan and an empty aluminum pan is used as reference. Measurement is made in a normal-temperature and normal-humidity environment at a heating rate of 10° C./min within the measuring temperature range of from 30° C. to 200° C. To determine the maximum endothermic peak of the wax, the temperature which comes to be the peak top in the course of Heating II is measured.

—Measurement of Average Primary Particle Diameter of Silica and Titanium Oxide Fine Particles—

Fine particles on the surfaces of toner particles enlarged on a field emission scanning electron microscope FE-SEM (S-4700, manufactured by Hitachi Ltd.) at 100,000 magnifications are photographed. Using the enlarged photograph thus taken, particle diameters (breadths, in regard to elliptic titanium) of 300 fine particles present in the visual field are measured to determine their number-average particle diameter (D1).

EXAMPLES

The present invention is described below by giving specific working examples. The present invention is by no means limited to these examples.

| Production of Polyester Resin 1 | (by weight) |
|---|---|
| Polyoxypropylene(2.2)-2,2-bis(4-hydroxyphenyl)propane | 10 parts |
| Polyoxyethylene(2.2)-2,2-bis(4-hydroxyphenyl)propane | 40 parts |
| Terephthalic acid | 20 parts |
| Trimellitic anhydride | 4 parts |
| Fumaric acid | 26 parts |
| Tin 2-ethylhexanoate | 0.05 part |

The above materials were charged into an autoclave having a thermometer and a stirrer, and were allowed to react at 200 to 210° C. for about 5 hours in an atmosphere of nitrogen to obtain Polyester Resin 1. The molecular weight of the polyester resin obtained was measured by GPC to obtain the results shown in Table 1.

| Production of Polyester Resin 2 | (by weight) |
|---|---|
| Polyoxypropylene(2.2)-2,2-bis(4-hydroxyphenyl)propane | 40 parts |
| Polyoxyethylene(2.2)-2,2-bis(4-hydroxyphenyl)propane | 10 parts |
| Terephthalic acid | 10 parts |
| Trimellitic anhydride | 1 part |
| Fumaric acid | 39 parts |
| Tin 2-ethylhexanoate | 0.05 part |

The above materials were charged into an autoclave having a thermometer and a stirrer, and were allowed to react at 210 to 220° C. for about 4 hours in an atmosphere of nitrogen to obtain Polyester Resin 2. The molecular weight of the polyester resin obtained was measured by GPC to obtain the results shown in Table 1.

| Production of Polyester Resin 3 | (by weight) |
|---|---|
| Terephthalic acid | 81 parts |
| 1,4-Cyclohexanedicarboxylic acid | 83 parts |
| Propylene glycol | 167 parts |
| Antimony trioxide | 0.09 part |

The above materials were charged into an autoclave having a thermometer and a stirrer, and were heated at 170 to 220° C. for 180 minutes to carry out esterification reaction. Next, the temperature of the reaction system was raised to 250° C. and the pressure of the system was set to 1 to 10 mmHg, where the reaction was continued for 3 hours to obtain Polyester Resin 3. The molecular weight of the polyester resin obtained was measured by GPC to obtain the results shown in Table 1.

TABLE 1

| | | Molecular weight GPC measurement results | | |
|---|---|---|---|---|
| | Tg (° C.) | Mw ($\times 10^3$) | Mn ($\times 10^3$) | Mw/Mn |
| Polyester Resin 1: | 62 | 100 | 3.6 | 27.8 |
| Polyester Resin 2: | 52 | 12.5 | 2.7 | 4.6 |
| Polyester Resin 3: | 58 | 40.0 | 18.3 | 2.2 |

Preparation of Additive for Toner

Into an autoclave having a thermometer and a stirrer, a mixture of α-methylstyrene, styrene and dehydrated and purified toluene and a boron trifluoride phenolate complex (phenol: 1.7 time equivalent weight) diluted to 1/10 with dehydrated and purified toluene were continuously fed, and polymerization reaction was carried out at a reaction temperature of 5° C. The α-methylstyrene and styrene were in a molar ratio of a proportion of 60/40, the mixture of monomers and toluene was fed at a rate of 1.0 liter/hour, and the catalyst diluted was fed at a rate of 90 ml/hour. The resultant reaction mixture was moved to a second-stage autoclave, and the polymerization reaction was continued at 5° C. Thereafter, at the time the total residence time in the first-stage and second-stage autoclaves came to be 2 hours, the reaction mixture was continuously discharged. Then, 1 liter of the reaction mixture was collected at the time the residence time came to be three times, where the polymerization reaction was completed. After the polymerization was completed, an aqueous 1 mol/liter NaOH solution was added to the reaction mixture collected, and the catalyst residue was delimed. The reaction mixture obtained was further washed five times with a large quantity of water, and thereafter the solvent and unreacted monomers were evaporated off under reduced pressure by means of an evaporator to obtain an additive for toner. The additive for toner thus obtained had a softening point Tm of 123° C., a number-average molecular weight Mn of 1,500 and a weight-average molecular weight Mw of 2,590.

| Toner Production Example | |
|---|---|
| Polyester Resin 1 | 80 parts |
| Polyester Resin 3 | 20 parts |
| C.I. Pigment Blue 15:3 | 3 parts |
| Wax A (normal paraffin; DSC peak temperature: 76° C.; Mn: 580) | 5 parts |
| Additive for toner | 5 parts |
| 3,5-Di-tert-butylsalicylic acid aluminum compound | 1 part |

Materials formulated as shown above were premixed by means of Henschel mixer, and the mixture obtained was melt-kneaded using a twin-screw extrusion kneader, setting material temperature at 140° C. The kneaded product obtained was cooled and thereafter crushed by means of a hammer mill into a crushed product of about 1 to 2 mm in diameter. The crushed product was then finely pulverized by means of a fine grinding mill of an air jet system into particles of about 15 μm or less in diameter. The finely pulverized product thus obtained was subjected to surface modification using the surface modifying apparatus as shown in FIGS. 1 and 2, at a number of dispersing rotor revolution of 100 $S^{-1}$ (rotational peripheral speed: 130 m/sec) for 45 seconds while removing fine particles at a number of dispersing-rotor revolution of 120 $S^{-1}$ (after the feeding of the finely pulverized product through the material feed opening 3 was completed, the surface modification was carried out for 45 seconds and then the discharge valve 8 was opened to take out the surface-modified product). In that surface modification, ten rectangular pins were provided on the top of the dispersing rotor 6, and the clearance between the lower end of the guide cylinder 9 and the rectangular pins on the dispersing rotor 6 was set to 30 mm, and the clearance between the dispersing rotor 6 and the liner 4 was set to 5 mm. Also, the air flow of the blower was set to 14 $m^3$/min, and temperature of the refrigerant made to run through the jacket and the cold air temperature T1 were set to −20° C. Thus, Toner Base Particles 1 were obtained, having a weight-average particle diameter (D4) of 6.0 μm.

To 100 parts by weight of the above Toner Base Particles 1, 1.0 part by weight of spherical silica (average primary particle diameter: 120 nm) produced by the sol-gel process and hydrophobic-treated with hexamethyldisilazane, 0.7 part by weight of elliptic titanium oxide particles (average primary particle diameter: 15 nm) treated with n-$C_4H_9Si(OCH_3)_3$ and 0.7 part by weight of spherical silica (number-average particle diameter: 18 nm) treated with dimethylsilicone oil were externally added by means of Henschel mixer to obtain Toner 1. Toner materials and physical properties are shown in FIGS. 2 and 3.

Toners 2 to 18 were produced in the same manner but changing the materials as shown in FIGS. 2 and 3 and changing material-kneading temperature and surface modifying time of the surface modifying apparatus. Toner materials and physical properties are shown in FIGS. 2 and 3. Incidentally, Wax B in Table 2 is normal paraffin (DSC peak temperature: 70° C.; Mn: 470).

Toners 1 to 18 were each further blended with magnetic manganese magnesium ferrite carrier particles (number-average particle diameter: 50 μm) surface-coated with a silicone resin, so as to be in a toner concentration of 7% by weight, to obtain Two-componet Developers 1 to 18, respectively.

TABLE 2

| | Resin (s) | (pbw) | Colorant (pbw) | Release agent (pbw) | Additive I (pbw) | Additive II (pbw) |
|---|---|---|---|---|---|---|
| Toner 1 | PES resin 1: | (80) | C.I. Pig. Blue 15:3 | Wax A | Additive for toner | 3,5-TBSAl |
| | PES resin 3: | (20) | (3) | (5) | (5) | (1) |
| Toner 2 | PES resin 1: | (30) | C.I. Pig. Blue 15:3 | Wax A | Additive for toner | 3,5-TBSAl |
| | PES resin 2: | (70) | (3) | (5) | (5) | (1) |
| Toner 3 | PES resin 1: | (30) | C.I. Pig. Blue 15:3 | Wax A | Additive for toner | 3,5-TBSAl |
| | PES resin 3: | (70) | (3) | (5) | (5) | (1) |
| Toner 4 | PES resin 1: | (30) | C.I. Pig. Blue 15:3 | Wax A | — | 3,5-TBSAl |
| | PES resin 2: | (70) | (3) | (4) | | (1) |
| Toner 5 | PES resin 1: | (30) | C.I. Pig. Blue 15:3 | Wax B | 3,5-TBSZr | 5-TOSAl |
| | PES resin 3: | (70) | (3) | (5) | (2) | (1) |
| Toner 6 | PES resin 1: | (30) | C.I. Pig. Blue 15:3 | Wax A | — | 3,5-TBSAl |
| | PES resin 2: | (70) | (3) | (4) | | (1) |
| Toner 7 | PES resin 1: | (30) | C.I. Pig. Blue 15:3 | Wax B | 3,5-TBSZr | 5-TOSAl |
| | PES resin 3: | (70) | (3) | (5) | (2) | (1) |
| Toner 8 | PES resin 1: | (30) | C.I. Pig. Blue 15:3 | Wax A | — | 3,5-TBSAl |
| | PES resin 2: | (70) | (3) | (4) | | (1) |
| Toner 9 | PES resin 1: | (30) | C.I. Pig. Blue 15:3 | Wax B | 3,5-TBSZr | 5-TOSAl |
| | PES resin 3: | (70) | (3) | (5) | (2) | (1) |
| Toner 10 | PES resin 1: | (80) | C.I. Pig. Red 122 | Wax A | Additive for toner | 3,5-TBSAl |
| | PES resin 3: | (20) | (4) | (5) | (5) | (1) |
| Toner 11 | PES resin 1: | (80) | C.I. Pig. Yellow 180 | Wax A | Additive for toner | 3,5-TBSAl |
| | PES resin 3: | (20) | (5) | (5) | (5) | (1) |
| Toner 12 | PES resin 1: | (80) | Carbon black | Wax A | Additive for toner | 3,5-TBSAl |
| | PES resin 3: | (20) | (5) | (5) | (5) | (1) |
| Toner 13 | PES resin 2 | | C.I. Pig. Blue 15:3 | Wax B | Additive for toner | 5-TOSAl |
| | | (100) | (3) | (4) | (5) | (2) |
| Toner 14 | PES resin 3 | | C.I. Pig. Blue 15:3 | Wax B | Additive for toner | 5-TOSAl |
| | | (100) | (3) | (1) | (5) | (3) |
| Toner 15 | PES resin 2 | | C.I. Pig. Blue 15:3 | Wax B | Additive for toner | 5-TOSAl |
| | | (100) | (3) | (4) | (5) | (2) |
| Toner 16 | PES resin 3 | | C.I. Pig. Blue 15:3 | Wax B | Additive for toner | 5-TOSAl |
| | | (100) | (3) | (1) | (5) | (3) |
| Toner 17 | PES resin 2 | | C.I. Pig. Blue 15:3 | Wax A | — | Boron benzylate |
| | | (100) | (3) | (4) | | (2) |
| Toner 18 | PES resin 3 | | C.I. Pig. Blue 15:3 | Wax B | 3,5-TBSZr | 5-TOSAl |
| | | (100) | (3) | (8) | (4) | (4) |

PES resin: Polyester resin
3,5-TBSAl: 3,5-Di-tert-butylsalithylic acid aluminum compound
3,5-TBSZr: 3,5-Di-tert-butylsalithylic acid zirconinum compound
5-TOSAl: 5-tert-Octylsalithylic acid aluminum compound

TABLE 3

| | Kneading temp. (° C.) | SMT* (sec) | External additive (s) | (pbw) | Average circularity | Maximum displacement quantity St (μm) | Plastic displacement quantity It (μm) | Elastic deformation percentage Et (%) |
|---|---|---|---|---|---|---|---|---|
| Toner 1 | 140 | 45 | Elliptic titanium oxide (15 nm) | (0.7) | 0.941 | 0.167 | 0.114 | 31.74 |
| | | | Oil-treated silica (18 nm) | (0.7) | | | | |
| | | | Sperical silica (120 nm) | (1.0) | | | | |

TABLE 3-continued

| | Kneading temp. (° C.) | SMT* (sec) | External additive (s) | (pbw) | Average circularity | Maximum displacement quantity St (μm) | Plastic displacement quantity It (μm) | Elastic deformation percentage Et (%) |
|---|---|---|---|---|---|---|---|---|
| Toner 2 | 140 | 45 | Elliptic titanium oxide (15 nm) | (0.7) | 0.940 | 0.215 | 0.130 | 39.53 |
| | | | Oil-treated silica (18 nm) | (0.7) | | | | |
| | | | Sperical silica (120 nm) | (1.0) | | | | |
| Toner 3 | 140 | 45 | Elliptic titanium oxide (15 nm) | (0.7) | 0.937 | 0.091 | 0.054 | 40.66 |
| | | | Oil-treated silica (18 nm) | (0.7) | | | | |
| | | | Sperical silica (120 nm) | (1.0) | | | | |
| Toner 4 | 100 | 45 | Elliptic titanium oxide (15 nm) | (0.7) | 0.936 | 0.229 | 0.099 | 56.77 |
| | | | Oil-treated silica (18 nm) | (0.7) | | | | |
| | | | Sperical silica (120 nm) | (1.0) | | | | |
| Toner 5 | 160 | 45 | Elliptic titanium oxide (15 nm) | (0.7) | 0.932 | 0.085 | 0.062 | 27.06 |
| | | | Oil-treated silica (18 nm) | (0.7) | | | | |
| | | | Sperical silica (120 nm) | (1.0) | | | | |
| Toner 6 | 100 | 70 | Elliptic titanium oxide (15 nm) | (0.7) | 0.956 | 0.231 | 0.099 | 57.14 |
| | | | Oil-treated silica (18 nm) | (0.7) | | | | |
| | | | Sperical silica (120 nm) | (1.0) | | | | |
| Toner 7 | 160 | 30 | Elliptic titanium oxide (15 nm) | (0.7) | 0.923 | 0.084 | 0.062 | 26.19 |
| | | | Oil-treated silica (18 nm) | (0.7) | | | | |
| | | | Sperical silica (120 nm) | (1.0) | | | | |
| Toner 8 | 100 | 70 | Elliptic titanium oxide (15 nm) | (1.0) | 0.956 | 0.239 | 0.100 | 58.16 |
| Toner 9 | 160 | 30 | Elliptic titanium oxide (15 nm) | (1.0) | 0.923 | 0.083 | 0.062 | 25.30 |
| Toner 10 | 140 | 45 | Elliptic titanium oxide (15 nm) | (0.7) | 0.942 | 0.166 | 0.116 | 30.12 |
| | | | Oil-treated silica (18 nm) (0.7) | | | | | |
| | | | Sperical silica (120 nm) (1.0) | | | | | |
| Toner 11 | 140 | 45 | Elliptic titanium oxide (15 nm) | (0.7) | 0.938 | 0.170 | 0.110 | 35.29 |
| | | | Oil-treated silica (18 nm) | (0.7) | | | | |
| | | | Sperical silica (120 nm) | (1.0) | | | | |
| Toner 12 | 140 | 45 | Elliptic titanium oxide (15 nm) | (0.7) | 0.942 | 0.165 | 0.111 | 32.73 |
| | | | Oil-treated silica (18 nm) | (0.7) | | | | |
| | | | Sperical silica (120 nm) | (1.0) | | | | |
| Toner 13 | 100 | 45 | Elliptic titanium oxide (15 nm) | (1.0) | 0.950 | 0.235 | 0.091 | 61.28 |
| Toner 14 | 180 | 45 | Elliptic titanium oxide (15 nm) | (1.0) | 0.926 | 0.079 | 0.060 | 24.05 |
| Toner 15 | 100 | 70 | Elliptic titanium oxide (15 nm) | (1.0) | 0.964 | 0.238 | 0.091 | 61.76 |
| Toner 16 | 180 | 30 | Elliptic titanium oxide (15 nm) | (1.0) | 0.916 | 0.077 | 0.059 | 23.38 |
| Toner 17 | 100 | 70 | Elliptic titanium oxide (15 nm) | (1.0) | 0.966 | 0.255 | 0.094 | 63.14 |
| Toner 18 | 180 | 30 | Elliptic titanium oxide (15 nm) | (1.0) | 0.913 | 0.073 | 0.056 | 23.29 |

*Surface modification time in surface modifying apparatus

Intermediate Transfer Belt

Production Examples

Raw-material pellets for each layer, composed chiefty of resins or rubbers as shown in table 4, were made ready for use. Kneaded products of these pellets were fed from their respective extruders to a multi-layer circular die, and were extruded while being laminated in the die. The multi-layer cylindrical body thus extruded was cooled with a cooling mandrel inserted to the interior of the former, and its size was regulated to obtain a conductive cylindrical body. This was cut in the direction crossing the axial direction. In this way, intermediate transfer belts of multi-layer structure, Belts 1 to 6, were obtained. The thickness of each layer, and the maximum displacement quantity, plastic displacement quantity and elastic deformation percentage of each intermediate transfer belt are shown in Table 4.

Examples 1 to 10 & Comparative Examples 1 to 9

Cyan Developer 1 was fed to the station Pa on the left end of the image forming apparatus shown in FIG. 3, and images were reproduced in the printer mode, using plain paper (Color Laser Copier Paper TKCLA4, available from CANON INC.) and in a normal environment (23° C./60% RH). Process speed was set to 300 mm/sec. As an original image, an image of 25% in area percentage was used, and a continuous 20,000-sheet running print test was conducted.

Incidentally, an assembly having the structure shown in FIG. 4 was used as the intermediate transfer belt cleaning assembly. As the fur brush, used was one made of conductive Rayon fibers with carbon black dispersed therein and having a thickness of 8 denier/filament and a hair setting density of 200,000 hairs/inch$^2$. The fur brush was son set that its peripheral speed was 125% with respect to the intermediate transfer belt and it rotated in the reverse direction at the contact zone. Also, a voltage of +1,000 V was applied to the metal roller, and the potential difference between the fur brush and the intermediate transfer belt was 900 V.

(1) Transfer Performance:

After the running test was finished, belt-shaped solid images with an image area percentage of 5% were printed to perform image formation, where the quantity of toner (per unit area) in toner images before transfer and the quantity of toner (per unit area) after transfer were measured. From the values obtained, transfer efficiency was calculated in the following way. Incidentally, the image formation was performed on one sheet each for the evaluation of primary transfer and the evaluation of secondary transfer.

Primary transfer efficiency (%)={(toner quantity on intermediate transfer member)/(toner quantity before transfer on photosensitive member)}×100

Secondary transfer efficiency (%)={(toner quantity on transfer material)/(toner quantity on intermediate transfer member)}×100

Evaluation was made according to the following criteria to make judgement as post-running transfer efficiency.

A: Very good (92% or more).

B: Good (88% to less than 92%).

C: Average (84% to less than 88%).

D: Poor (less than 84%).

(2) Evaluation on blank Areas Caused by Poor Transfer:

To make evaluation on blank areas caused by poor transfer, after the running test was finished, a character pattern "驚" shown in FIG. 5A were printed on cardboard (128 g/m$^2$), where evaluation on hollow characters (the state shown in FIG. 5B) was visually made according to the following criteria.

A: Almost no hollow characters occur.

B: Slight hollow characters are seen.

C: Hollow characters are seen.

D: Conspicuous hollow characters are seen.

(3) Coarseness of Images in Transfer:

After the running test was finished, unfixed toner images at a point of time where a fine-line image (7 lines/1 mm) was transferred to a transfer material were reproduced, and images were obtained which were fixed in a 100° C. oven under application of no pressure to obtain fixed images. The resolution of images thus fixed was observed using a magnifier to make evaluation by ascertaining the degree to which the toner scattered and the resolution lowered. More specifically, the number of distinguishable lines was evaluated according to the following criteria. Here, the number of distinguishable lines was shown as an average value at 10 spots for each of lines in vertical direction and lines in horizontal direction.

A: 7 lines.

B: 5 or 6 lines.

C: 3 or 4 lines.

D: 2 lines or less.

(4) Evaluation of Cleaning Performance:

To make evaluation of cleaning performance, after the running test was finished, solid images with an image density of 0.6 mg/cm$^2$ were reproduced. Then, (A) on the intermediate transfer member standing immediately after the toner was transferred therefrom and (B) on the intermediate transfer member having been cleaned after the toner was transferred therefrom, a transparent pressure-sensitive tape (SUPERSTEC, available from Lintec Corporation) was stuck to each intermediate transfer member surface and thereafter peeled therefrom to collect any residual toner. The transparent pressure-sensitive tape on which the residual toner was collected was stuck to plain paper (Color Laser Copier Paper TKCLA4, available from CANON INC.), where the image density was measured with a color color-difference meter X-Rite 500 Series Spectrodensitometer (manufactured by X-Rite), and cleaning efficiency was calculated according to the following expression.

$$\text{Cleaning efficiency (\%)}=[1-(\text{image density of } (B)\text{-sample}/\text{image density of } (A)\text{-sample})]\times 100$$

To make evaluation, the cleaning performance was judged according to the following criteria.

A: Very good (the cleaning efficiency is 98% or more).

B: Good (the cleaning efficiency is 96% to less than 98%).

C: Average (the cleaning efficiency is 94% to less than 96%).

D: Poor (the cleaning efficiency is less than 94%).

(5) Evaluation on Toner Melt Adhesion and Scratches on Intermediate Transfer Member:

After the running test was finished, the photosensitive member was replaced with new one. Making sure that there was neither melt adhesion nor scratch on the photosensitive member, solid images with an image density of 0.6 mg/cm$^2$ were printed.

Blank areas caused by melt adhesion of toner onto the intermediate transfer member was counted to make evaluation on the melt adhesion to the intermediate transfer member. Incidentally, evaluation criteria on the melt adhesion to the intermediate transfer member are as follows:

A: 2 or less blank areas on the solid image.

B: 3 to 5 blank areas on the solid image.

C: 6 to 8 blank areas on the solid image.

D: 9 or more blank areas on the solid image.

White lines caused by scratches on the intermediate transfer member was also counted to make evaluation on the scratches on the intermediate transfer member. Incidentally, evaluation criteria on the scratches on the intermediate transfer member are as follows:

A: 0 to 1 white line on the solid image.

B: 2 to 4 white lines on the solid image.

C: 4 to 6 white lines on the solid image.

D: 7 or more white lines on the solid image.

In Example 1, good transfer performance and cleaning performance were achieved also after the continuous-printing 20,000-sheet running test. Also, the faulty images such as hollow characters or coarse images did not come about. Still also, neither the melt adhesion of toner to, nor the scratches on, the intermediate transfer member did not occur, showing good running performance in the continuous-printing 20,000-sheet running test.

In Examples 2 to 10 as well, evaluation results were obtained which were well satisfactory as a serviceable level.

Table 5 shows combinations of toners and intermediate, transfer members, and Table 6, the results of evaluation.

Example 11

A running test was conducted in the same manner as in Example 1 except that the intermediate transfer belt cleaning assembly was changed for an electrostatic cleaning assembly making use of a charging roller. The results of evaluation are shown in Table 6.

Incidentally, as the charging roller, used was a roller of 20 mm in diameter on a stainless steel mandrel of which a conductive elastic layer of 8 mm in layer thickness and a surface layer of 20 μm in layer thickness were provided. Also, a voltage of +1,500 V was applied to the charging roller, and the charging roller was so set that its peripheral speed was 125% with respect to the intermediate transfer belt and it rotated in the reverse direction at the contact zone.

Example 12

Using Two-component Developers 1, 10, 11 and 12 having corresponding toners, 20,000-sheet running tests were conducted in the same manner as in Example 1 but in a full-color mode, using the image forming apparatus shown in FIGS. 3 and 4. As the result of the running tests, they showed good primary transfer efficiency, secondary transfer efficiency and cleaning performance, without causing any of blank areas caused by poor transfer, coarseness, and melt adhesion or scratches on the intermediate transfer member.

Comparative Examples 1 to 11

In Comparative Examples 1 to 11 as well, 20,000-sheet running tests were conducted in the same manner as in Example 1 but in combination of toners and intermediate transfer members as shown in Table 5.

Table 6 show the results of evaluation.

TABLE 4

| | Substrate layer | | Elastic layer | | Surface layer | | Displacement quantity | | Elastic |
|---|---|---|---|---|---|---|---|---|---|
| | Material & thickness | | Material & thickness | | Material & thickness | | Maximum Sb | Plastic Ib | deformation Eb |
| | | (μm) | | (μm) | | (μm) | (μm) | (μm) | (%) |
| Belt 1: | PVF | 100 | CR | 400 | PTFE | 10 | 0.48 | 0.15 | 68.75 |
| Belt 2: | PVF | 150 | SiR | 700 | PTFE | 5 | 0.79 | 0.20 | 74.68 |
| Belt 3: | PVF | 100 | SBR | 100 | PTFE | 10 | 0.13 | 0.064 | 50.77 |
| Belt 4: | PVF | 50 | — | — | IR | 1,500 | 1.10 | 0.25 | 77.27 |
| Belt 5: | PVF | 200 | — | — | — | — | 0.081 | 0.043 | 46.91 |
| Belt 6: | PI | 100 | — | — | — | — | 0.038 | 0.023 | 39.47 |

PVF: Polyvinylidene fluoride;
PI: Polyimide
CR: Chloroprene rubber;
SiR: Silicone rubber
SBR: Styrene butadiene rubber
PTFE: Polytetrafluoroethylene;
IR: Isoprene rubber

TABLE 5

| | Toner | Belt | Eb + Et (%) |
|---|---|---|---|
| Example: | | | |
| 1 | 1 | 1 | 100.49 |
| 2 | 2 | 1 | 108.28 |
| 3 | 3 | 1 | 109.41 |
| 4 | 4 | 1 | 125.52 |
| 5 | 5 | 1 | 95.81 |
| 6 | 6 | 1 | 125.89 |
| 7 | 7 | 1 | 94.94 |
| 8 | 8 | 1 | 126.91 |
| 9 | 9 | 1 | 94.05 |
| 10 | 9 | 3 | 76.96 |
| Comparative Example: | | | |
| 1 | 13 | 2 | 135.96 |
| 2 | 14 | 3 | 74.82 |

TABLE 5-continued

| | Toner | Belt | Eb + Et (%) |
|---|---|---|---|
| 3 | 15 | 2 | 136.44 |
| 4 | 16 | 3 | 74.15 |
| 5 | 17 | 2 | 137.82 |
| 6 | 18 | 3 | 74.06 |
| 7 | 17 | 4 | 140.41 |
| 8 | 18 | 5 | 70.20 |
| 9 | 18 | 6 | 62.76 |
| 10 | 8 | 4 | 136.13 |
| 11 | 7 | 5 | 72.21 |

TABLE 6

| | Transfer efficiency | | | Coarse | Cleaning | On solid images | |
|---|---|---|---|---|---|---|---|
| | Primary | Secondary | *Blank areas | images | efficiency | Blank areas | White lines |
| Example: | | | | | | | |
| 1 | A (96%) | A (95%) | A | A (7 ll.) | A (100%) | A (0 l.) | A (0 l.) |
| 2 | A (98%) | A (95%) | A | A (7 ll.) | A (99%) | A (1 l.) | A (0 l.) |
| 3 | A (94%) | A (94%) | A | B (6 ll.) | A (99%) | A (0 l.) | A (1 l.) |
| 4 | A (97%) | A (92%) | A | A (7 ll.) | A (99%) | A (2 ll.) | A (0 l.) |
| 5 | A (92%) | A (93%) | A | B (5 ll.) | A (98%) | A (0 l.) | B (2 ll.) |
| 6 | A (98%) | A (94%) | A | A (7 ll.) | A (98%) | B (3 ll.) | A (0 l.) |
| 7 | B (91%) | B (92%) | A | B (5 ll.) | A (98%) | A (0 l.) | B (2 ll.) |
| 8 | A (95%) | B (89%) | A | B (6 ll.) | B (96%) | B (3 ll.) | B (2 ll.) |
| 9 | B (91%) | A (92%) | A | B (5 ll.) | B (97%) | A (0 l.) | B (2 ll.) |

TABLE 6-continued

| | Transfer efficiency | | | Coarse | Cleaning | On solid images | |
|---|---|---|---|---|---|---|---|
| | Primary | Secondary | *Blank areas | images | efficiency | Blank areas | White lines |
| 10 | B (89%) | B (91%) | B | B (5 ll.) | B (96%) | A (0 l.) | B (2 ll.) |
| 11 | A (95%) | A (95%) | A | A (7 ll.) | A (99%) | A (1 l.) | A (1 l.) |
| Comparative Example: | | | | | | | |
| 1 | B (91%) | C (87%) | A | B (5 ll.) | C (95%) | C (6 ll.) | B (3 ll.) |
| 2 | C (87%) | B (88%) | B | C (4 ll.) | C (95%) | B (3 ll.) | C (4 ll.) |
| 3 | B (91%) | C (87%) | B | C (4 ll.) | C (95%) | C (8 ll.) | B (3 ll.) |
| 4 | C (86%) | B (88%) | C | C (3 ll.) | C (94%) | B (5 ll.) | C (4 ll.) |
| 5 | C (86%) | C (85%) | B | C (3 ll.) | C (94%) | C (7 ll.) | C (4 ll.) |
| 6 | C (86%) | C (86%) | C | C (3 ll.) | D (93%) | C (6 ll.) | C (5 ll.) |
| 7 | C (87%) | D (83%) | B | D (2 ll.) | D (93%) | D (9 ll.) | D (7 ll.) |
| 8 | D (82%) | C (85%) | C | D (2 ll.) | D (92%) | C (7 ll.) | C (6 ll.) |
| 9 | D (83%) | D (80%) | D | D (1 l.) | D (91%) | C (8 ll.) | C (6 ll.) |
| 10 | B (90%) | C (87%) | B | D (2 ll.) | C (94%) | D (9 ll.) | D (7 ll.) |
| 11 | C (86%) | C (85%) | C | C (3 ll.) | D (93%) | C (6 ll.) | C (5 ll.) |

*caused by poor transfer;
ll.: lines;
l.: line

This application claims the priority from Japanese Patent Application No. 2004-130278 filed Apr. 26, 2004, which is hereby incorporated by reference herein.

What is claimed is:

1. An image forming method comprising:

a primary transferring step for transferring to an intermediate transfer member a toner image formed on a photosensitive member;

a secondary transferring step for transferring to a transfer material the toner image held on the intermediate transfer member; and after the secondary transferring step, a cleaning step for removing the toner remaining on the intermediate transfer member by bringing a cleaning means into contact with the intermediate transfer member, wherein;

the cleaning means is one of a fur brush and a charging roller;

the intermediate transfer member has a maximum displacement quantity (Sb) in a range of 0.10 μm to 1.00 μm against a load of $9.8\times10^{-5}$ N, and has an elastic deformation percentage (Eb) (%) of 50 or more which is represented by the following expression:

$$Eb=(Sb-Ib)\times100/Sb$$

where Ib represents the plastic displacement quantity (μm) of the intermediate transfer member against the load of $9.8\times10^{-5}$ N;

a toner which forms the toner image has an average circularity of 0.920 to 0.960 in its particles having a circle equivalent diameter of 2 μm or more, has a maximum displacement quantity (St) in the range of 0.06 μm to 0.24 μm against a load of $9.8\times10^{-5}$ N, and has an elastic deformation percentage (Et) (%) of 25 to 60 which is represented by the following expression:

$$Et=(St-It)\times100/St$$

where It represents the plastic displacement quantity (μm) of the toner against the load of $9.8\times10^{-5}$ N; and the elastic deformation percentage of the intermediate transfer member and the elastic deformation percentage of the toner satisfy the following conditional expression:

$$75\leqq Eb+Et\leqq135.$$

2. The image forming method according to claim 1, wherein the toner comprises toner particles having at least i) toner base particles and ii) fine particles having an average primary particle diameter of 70 nm to 150 nm, and the fine particles are in a content of 0.5 part to 4.0 parts by weight based on 100 parts by weight of the toner base particles.

3. An image forming apparatus comprising a photosensitive member, an intermediate transfer member and a cleaning means, said image forming apparatus being used in an image forming method, said image forming method comprising:

a primary transferring step for transferring to the intermediate transfer member a toner image formed on the photosensitive member;

a secondary transferring step for transferring to a transfer material the toner image held on the intermediate transfer member; and after the secondary transferring step, a cleaning step for removing the toner remaining on the intermediate transfer member by bringing the cleaning means into contact with the intermediate transfer member, wherein;

said cleaning means is one of a fur brush and a charging roller;

said intermediate transfer member has a maximum displacement quantity (Sb) in a range of 0.10 μm to 1.00 μm against a load of $9.8\times10^{-5}$ N, and has an elastic deformation percentage (Eb) (%) of 50 or more which is represented by the following expression:

$$Eb=(Sb-Ib)\times100/Sb$$

where Ib represents the plastic displacement quantity (μm) of the intermediate transfer member against the load of $9.8\times10^{-5}$ N;

a toner which forms said toner image has an average circularity of 0.920 to 0.960 in its particles having a circle equivalent diameter of 2 μm or more, has a maximum displacement quantity (St) in the range of 0.06 μm to 0.24 μm against a load of $9.8\times10^{-5}$ N, and has an elastic deformation percentage (Et) (%) of 25 to 60 which is represented by the following expression:

$$Et=(St-It)\times100/St$$

where It represents the plastic displacement quantity (μm) of the toner against the load of $9.8\times10^{-5}$ N; and the elastic deformation percentage of the intermediate transfer member and the elastic deformation percentage of the toner satisfy the following conditional expression:

$$75\leqq Eb+Et\leqq135.$$

4. The image forming apparatus according to claim 3, wherein said toner comprises toner particles having at least i) toner base particles and ii) fine particles having an average primary particle diameter of 70 nm to 150 nm, and the fine particles are in a content of 0.5 part to 4.0 parts by weight based on 100 parts by weight of the toner base particles.

* * * * *

UNITED STATES PATENT AND TRADEMARK OFFICE

CERTIFICATE OF CORRECTION

PATENT NO. : 7,381,515 B2
APPLICATION NO. : 11/107736
DATED : June 3, 2008
INVENTOR(S) : Nobuyoshi Sugahara et al.

It is certified that error appears in the above-identified patent and that said Letters Patent is hereby corrected as shown below:

COLUMN 3
Line 7, "wherein;" should read --wherein,--.
Line 55, "wherein;" should read --wherein,--.

COLUMN 6
Line 1, "come" should read --become--.

COLUMN 8
Line 30, "polyoxyethylene(2.0)-2,2-bis(4-hyd roxyphenyl)propane" should read --polyoxyethylene(2.0)-2,2-bis(4-hydroxyphenyl)propane--.

COLUMN 26
Line 36, "Cooling" (second occurrence) should read --cooling--.

COLUMN 32
Line 44, "son" should read --so--.

COLUMN 37
Line 51 Claim 1, "wherein;" should read --wherein:--.

COLUMN 39
Line 5 Claim 3, "wherein;" should read --wherein:--.

Signed and Sealed this

Fourth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,381,515 B2
APPLICATION NO. : 11/107736
DATED : June 3, 2008
INVENTOR(S) : Nobuyoshi Sugahara et al.

It is certified that error appears in the above-identified patent and that said Letters Patent is hereby corrected as shown below:

COLUMN 3
Line 7, “wherein;” should read --wherein,--.
Line 55, “wherein;” should read --wherein,--.

COLUMN 6
Line 1, “come” should read --become--.

COLUMN 8
Line 30, “polyoxyethylene(2.0)-2,2-bis(4-hyd roxyphenyl)propane” should read --polyoxyethylene(2.0)-2,2-bis(4-hydroxyphenyl)propane--.

COLUMN 26
Line 36, “Cooling” (second occurrence) should read --cooling--.

COLUMN 32
Line 44, “son” should read --so--.

COLUMN 37
Line 51, “wherein;” should read --wherein:--.

COLUMN 39
Line 5, claim 3 “wherein;” should read --wherein:--.

Signed and Sealed this

Eighteenth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,381,515 B2
APPLICATION NO. : 11/107736
DATED : June 3, 2008
INVENTOR(S) : Nobuyoshi Sugahara et al.

It is certified that error appears in the above-identified patent and that said Letters Patent is hereby corrected as shown below:

This certificate vacates the Certificate of Correction issued November 18, 2008. The certificate is a duplicate of the Certificate of Correction issued November 4, 2008. All requested changes were included in the Certificate of Correction issued November 4, 2008.

Signed and Sealed this

Ninth Day of December, 2008

JON W. DUDAS
*Director of the United States Patent and Trademark Office*